US007670269B2

(12) United States Patent
Webber et al.

(10) Patent No.: US 7,670,269 B2
(45) Date of Patent: Mar. 2, 2010

(54) CHEST PRESS EXERCISE MACHINE WITH SELF-ALIGNING PIVOTING USER SUPPORT

(75) Inventors: Randall T. Webber, La Jolla, CA (US); Bruce Hockridge, San Diego, CA (US); Jeffrey O. Meredith, Del Mar, CA (US)

(73) Assignee: Hoist Fitness Systems, Inc., San Diego, CA (US)

( * ) Notice: Subject to any disclaimer, the term of this patent is extended or adjusted under 35 U.S.C. 154(b) by 44 days.

(21) Appl. No.: 11/846,459

(22) Filed: Aug. 28, 2007

(65) Prior Publication Data

US 2008/0058176 A1 Mar. 6, 2008

Related U.S. Application Data

(60) Provisional application No. 60/824,575, filed on Sep. 5, 2006.

(51) Int. Cl.
*A63B 21/06* (2006.01)

(52) U.S. Cl. ..... 482/94; 482/51; 482/92; 482/93; 482/142; 434/29

(58) Field of Classification Search ..... 482/92–94, 482/51; 434/29
See application file for complete search history.

(56) References Cited

U.S. PATENT DOCUMENTS

| | | | |
|---|---|---|---|
| 248,121 | A | 10/1881 | Tuttle |
| 2,145,940 | A | 2/1939 | Marlowe |
| 2,252,156 | A | 8/1941 | Bell |
| 2,481,121 | A | 9/1949 | Kasten |
| 3,446,503 | A | 5/1969 | Lawton |
| 3,592,465 | A | 7/1971 | Fulkerson, Jr. |

(Continued)

FOREIGN PATENT DOCUMENTS

| | | | |
|---|---|---|---|
| CA | 2075331 | A | 2/1994 |

(Continued)

OTHER PUBLICATIONS

U.S. Appl. No. 11/846,437, filed Aug. 2007, Webber, et al.

(Continued)

*Primary Examiner*—Loan H Thanh
*Assistant Examiner*—Robert F Long
(74) *Attorney, Agent, or Firm*—Procopio, Cory, Hargreaves & Savitch LLP

(57) ABSTRACT

A chest press exercise machine has a self-aligning pivoting user support on a main frame and an exercise arm which is linked to the pivoting user support to translate movement of the exercise arm into movement of the user support. A user support pivot pivotally connects the user support to the main frame. A connecting link is movably associated with the user engagement device or exercise arm and at least one of the main frame, user support, or user support pivot. A user-activated positioning device controls positioning of the exercise arm in an exercise ready position at the start of an exercise. The user support pivot is positioned so that part of the combined weight of the user and user support is positioned on both sides of the gravitational centerline throughout the exercise movement and a portion of the combined weight passes through the centerline to redistribute the weight as the exercise arm is moved.

23 Claims, 25 Drawing Sheets

U.S. PATENT DOCUMENTS 3,640,528 A 2/1972 Proctor
3,707,285 A 12/1972 Martin
4,004,801 A 1/1977 Campanaro et al.
4,111,414 A 9/1978 Roberts
4,231,568 A 11/1980 Riley et al.
4,300,760 A 11/1981 Bobroff
4,441,708 A 4/1984 Brentham
4,632,390 A 12/1986 Richey
4,641,833 A 2/1987 Trethewey
4,684,126 A * 8/1987 Dalebout et al. ..... 482/138
4,700,946 A 10/1987 Breunig
4,743,010 A 5/1988 Geraci
4,793,608 A 12/1988 Mahnke et al.
4,822,038 A 4/1989 Maag
4,844,456 A 7/1989 Habing et al.
4,911,438 A 3/1990 Van Straaten
4,949,951 A 8/1990 Deola
4,949,958 A 8/1990 Richey
5,100,128 A 3/1992 Mabry
5,106,081 A 4/1992 Webb
5,108,095 A 4/1992 Nichols
5,250,013 A 10/1993 Brangi
5,254,067 A 10/1993 Habing et al.
5,263,914 A 11/1993 Simonson et al.
5,267,930 A 12/1993 Henes
5,299,997 A * 4/1994 Chen ..... 482/96
5,322,489 A 6/1994 Webb
5,330,404 A * 7/1994 Lopeteguy et al. ..... 482/91
5,330,405 A 7/1994 Habing et al.
5,334,120 A * 8/1994 Rasmussen ..... 482/97
5,342,269 A 8/1994 Huang et al.
5,342,270 A 8/1994 Jones
5,346,447 A 9/1994 Stearns
5,352,171 A 10/1994 Lin
5,354,248 A * 10/1994 Rawls et al. ..... 482/6
5,356,357 A 10/1994 Wang et al.
5,356,358 A 10/1994 Chu
D357,041 S * 4/1995 McBride et al. ..... D21/676
5,417,634 A * 5/1995 Habing ..... 482/99
5,421,796 A 6/1995 Jones et al.
5,437,589 A 8/1995 Habing
5,447,480 A 9/1995 Fulks
5,453,066 A 9/1995 Richter, Jr.
5,458,553 A * 10/1995 Wu ..... 482/95
5,478,298 A * 12/1995 Chen ..... 482/95
5,499,959 A 3/1996 Holmes et al.
5,503,608 A 4/1996 Chang
5,507,710 A 4/1996 Chen
5,520,599 A * 5/1996 Chen ..... 482/96
5,527,243 A * 6/1996 Chen ..... 482/72
5,527,249 A 6/1996 Harris
5,527,250 A 6/1996 Chen
5,533,953 A 7/1996 Lui et al.
5,540,639 A 7/1996 Potts et al.
D372,509 S * 8/1996 Yang ..... D21/676
5,547,444 A * 8/1996 Huang ..... 482/72
5,549,530 A 8/1996 Fulks
5,554,086 A 9/1996 Habing et al.
5,562,577 A 10/1996 Nichols et al.
5,573,482 A 11/1996 Wang et al.
5,580,340 A * 12/1996 Yu ..... 482/96
5,580,341 A 12/1996 Simonson
5,582,563 A 12/1996 Fan
5,603,678 A 2/1997 Wilson
5,616,105 A 4/1997 Wang
5,626,542 A 5/1997 Dalebout et al.
5,643,147 A * 7/1997 Huang ..... 482/72
5,643,152 A 7/1997 Simonson
5,658,227 A * 8/1997 Stearns ..... 482/96
D384,118 S * 9/1997 Deblauw ..... D21/665
5,669,865 A 9/1997 Gordon
5,672,142 A 9/1997 Wu
5,674,161 A * 10/1997 Lin ..... 482/96
5,676,626 A 10/1997 Huang
5,683,334 A 11/1997 Webber
5,690,593 A 11/1997 Huang
5,695,434 A 12/1997 Dalebout et al.
5,702,328 A 12/1997 Mansvelt
5,720,695 A 2/1998 Eckmann
5,722,918 A * 3/1998 Lee ..... 482/72
5,733,229 A 3/1998 Dalebout et al.
5,733,232 A 3/1998 Hsu
5,749,813 A 5/1998 Domzalski
5,803,882 A 9/1998 Habling et al.
5,810,698 A 9/1998 Hullett et al.
5,810,701 A 9/1998 Ellis et al.
5,827,158 A 10/1998 Drecksel
5,876,095 A 3/1999 Johnston
5,899,836 A 5/1999 Chen
5,906,564 A 5/1999 Jacobsen
5,938,570 A * 8/1999 Maresh ..... 482/57
5,938,571 A 8/1999 Stevens
5,944,641 A 8/1999 Habing
5,961,427 A * 10/1999 Habing et al. ..... 482/96
5,967,954 A 10/1999 Habling
5,989,165 A 11/1999 Gianelli et al.
5,997,446 A * 12/1999 Stearns ..... 482/96
5,997,447 A 12/1999 Gianelli et al.
6,004,247 A 12/1999 Webber
6,024,677 A 2/2000 Siwertz
6,071,216 A 6/2000 Gianelli et al.
6,074,328 A 6/2000 Johnson
6,080,091 A 6/2000 Habing et al.
6,086,521 A 7/2000 Solland
6,135,930 A 10/2000 Kuo
6,142,914 A * 11/2000 Crawford et al. ..... 482/51
6,142,917 A 11/2000 Gianelli et al.
6,152,864 A 11/2000 Gianelli et al.
6,162,153 A * 12/2000 Perez et al. ..... 482/96
6,244,995 B1 6/2001 Prsala
6,251,047 B1 6/2001 Stearns et al.
6,264,588 B1 7/2001 Ellis
6,302,832 B1 * 10/2001 Stearns ..... 482/96
6,312,366 B1 11/2001 Prusick
6,387,020 B1 5/2002 Simonson
6,394,937 B1 5/2002 Voris
6,491,609 B2 * 12/2002 Webber ..... 482/99
6,579,213 B1 6/2003 Webber et al.
6,605,024 B2 8/2003 Stearns
6,676,577 B2 1/2004 Stearns
6,752,748 B1 6/2004 Scotti
6,811,522 B1 11/2004 McQuinn
6,855,098 B2 2/2005 Reitz et al.
6,916,278 B2 7/2005 Webber
6,966,872 B2 11/2005 Eschenbach
6,971,978 B2 * 12/2005 Hyder ..... 482/142
7,052,444 B2 5/2006 Webber
7,052,446 B2 5/2006 Morris et al.
7,070,545 B2 * 7/2006 Lull et al. ..... 482/100
7,141,003 B2 * 11/2006 Wu ..... 482/51
7,141,008 B2 * 11/2006 Krull et al. ..... 482/70
7,220,221 B2 * 5/2007 Mosimann et al. ..... 482/100
7,223,213 B2 5/2007 Golesh
7,229,389 B2 * 6/2007 Hong ..... 482/96
7,322,906 B2 1/2008 Webber
7,331,911 B2 * 2/2008 Webber et al. ..... 482/137
7,335,140 B2 * 2/2008 Webber et al. ..... 482/98
7,357,761 B2 * 4/2008 Mattox ..... 482/125
7,361,125 B2 * 4/2008 Webber et al. ..... 482/95
7,384,381 B2 6/2008 Webber et al.
7,468,024 B2 12/2008 Webber et al.
2002/0013199 A1 1/2002 Giannelli et al.
2002/0103058 A1 8/2002 Webber
2002/0187879 A1 * 12/2002 Ball et al. ..... 482/72

| | | | | |
|---|---|---|---|---|
| 2003/0199362 | A1 | 10/2003 | Chamberlin | |
| 2005/0032611 | A1* | 2/2005 | Webber et al. | 482/72 |
| 2005/0096196 | A1* | 5/2005 | Webber et al. | 482/94 |
| 2005/0096197 | A1* | 5/2005 | Webber et al. | 482/94 |
| 2005/0096198 | A1* | 5/2005 | Webber et al. | 482/97 |
| 2006/0035764 | A1* | 2/2006 | Webber | 482/94 |
| 2006/0211549 | A1 | 9/2006 | Nohejl | |
| 2006/0247107 | A1* | 11/2006 | Carter | 482/99 |
| 2006/0276313 | A1 | 12/2006 | Hong | |
| 2007/0232462 | A1* | 10/2007 | Webber et al. | 482/93 |
| 2007/0293377 | A1 | 12/2007 | Webber et al. | |
| 2007/0293378 | A1 | 12/2007 | Webber et al. | |
| 2008/0058181 | A1* | 3/2008 | Webber et al. | 482/136 |
| 2008/0132389 | A1 | 6/2008 | Webber et al. | |
| 2008/0153677 | A1 | 6/2008 | Webber et al. | |
| 2008/0182732 | A1 | 7/2008 | Webber et al. | |
| 2008/0214365 | A1 | 9/2008 | Webber et al. | |
| 2008/0214367 | A1 | 9/2008 | Webber et al. | |
| 2008/0220950 | A1 | 9/2008 | Webber et al. | |
| 2008/0234110 | A1 | 9/2008 | Webber et al. | |
| 2008/0242517 | A1 | 10/2008 | Webber et al. | |
| 2008/0248929 | A1 | 10/2008 | Webber et al. | |

FOREIGN PATENT DOCUMENTS

| | | | |
|---|---|---|---|
| SU | 1674874 | A1 | 9/1991 |

OTHER PUBLICATIONS

U.S. Appl. No. 11/849,028, filed Aug. 2007, Webber, et al.
U.S. Appl. No. 11/848,012, filed Aug. 2007, Webber, et al.
U.S. Appl. No. 11/846,472, filed Aug. 2007, Webber, et al.
Boss Fitness Brochure, 1993.
Hammer Strength, Hammer Brochure, 1993.
FS-403 Shoulder Press, Flex Brochure, 1995.
Paramount Advanced Performance System—Legg Press AP—2800 (brochure dated 2000).
08003 Rower, Gym 80 Brochure, 2001.
Gym 80 Brochure, 2001.
Leg Press, Cybex International Brochure, 2002.
Flex Fitness Brochure, date unknown.
Pace, 318 Dip/Shrug, Hanley International Brochure, date unknown.
FA-508 Dip Machine, Flex Brochure, date unknown.
Sprint by Hogan Industries, date unknown.
Models 217 and 206-2, Polaris Brochure, date unknown.
Hoist Selectionized Duals HD Series, Hoist Brochure, 2002.
Gravity Gym Instruction Manual, Seated Bench Press, date unknown.
Seated Close Grip Bench Press, Gravity Gym Instruction Manual, date unknown.
Vertical Bench Press Machine, Hoist Brochure, 1993.
Sprint by Hogan Industries, Linear Motion Chest Press, date unknown.
Chest Press and Incline Press, plate-loaded, Cybex Brochure, 1996.
Leg Press Machine, Schwinn Natural Strength, European trade magazine, date unknown.
Low Back Machine, Hoist Brochure, HS1225, 2005.
How It Works Flyer, illustration of exercises performed on U.S. Patent No. 5,527,249 of Harris, date unknown.
Sprint Circuit, Hogan Industries Brochure, date unknown.

* cited by examiner

CHEST PRESS EXERCISE MACHINE WITH SELF-ALIGNING PIVOTING USER SUPPORT

RELATED APPLICATION

The present application claims the benefit of co-pending U.S. provisional patent application No. 60/824,575 filed Sep. 5, 2006, which is incorporated herein by reference in its entirety.

BACKGROUND

1. Field of the Invention

This invention relates generally to an exercise machine with a self-aligning pivoting user support, and is particularly concerned with a chest press exercise machine.

2. Related Art

A chest press is a compound exercise movement. There are two basic types of exercise movement, isolation and compound. Isolation exercises are designed to isolate a single muscle or muscle group and reduce body part movement to rotation of a single joint. Leg extensions and biceps curls are examples of isolation exercises. Compound movement involves more than one body part and requires multiple joint action. Chest press exercises are an example of a compound exercise movement.

Chest press exercise machines attempt to reproduce the exercise movement of a free weight chest press exercise using a barbell or dumbbell. One problem is the unnatural and exaggerated arcing movement often found in such machines, which often do not accurately simulate the natural body movement found in a free weight exercise.

SUMMARY

In one embodiment, an exercise machine has a pivoting seat or user support on a main frame and an exercise arm which is linked to the pivoting user support to translate movement of the exercise arm into movement of the user support. A pivoting mechanism which pivotally connects the user support to the main frame is designed to automatically align in order to maintain proper positioning of the user throughout the exercise motion. In one example, the exercise machine is adapted for performing chest press exercises and the linkage between the exercise arm movement and movement of the user support is configured to produce a slight arcing motion, similar to that of a free weight barbell or dumbbell exercise. The exercise machine may be designed for performing decline press, bench press, or incline press exercises. The movement of the user engagement device or exercise arm may be rotational or linear, and is linked to the user support to cause rotational movement of the user support.

In one embodiment, the user support has a primary support or seat and at least one secondary user support for supporting another part of the user's body, such as the back or feet. The secondary support and seat may be in fixed alignment to each other and travel together through the same range of motion and rotate together about the same pivot point. In one embodiment, the user support has a seat, back pad, and footrest all fixed relative to one another to travel together during the exercise movement. The fixed alignment between the supports keeps the user in the same position throughout the exercise.

The user support is linked to the exercise arm so that movement in the arm forces self-aligning movement in the user support, which is continuous throughout the exercise range of motion. By linking the movement of the user support to that of the exercise arm, the user may experience a more comfortable exercise movement that generally mimics the natural alignment in both the starting and finishing positions when performing a chest press exercise. The link between the user support and exercise arm is arranged to place handles on the exercise are at an appropriate position in front of a back pad on the user support in the exercise start position so that the user's hands are placed in front of their upper chest at the start of the exercise.

In one embodiment, an exercise arm positioning device travels with the exercise arm and is pivotally associated with at least one of the main frame and user support. The positioning device controls positioning of the exercise arm in an exercise ready position at the start of an exercise movement, and may be adjustable by the user to vary the exercise start position of the arm. A range of motion (ROM) adjuster may be incorporated in the positioning device in one example. In another example, the positioning device comprises a foot engageable cocking mechanism in front of the user support.

In this machine, the user engagement means travels separately from the user support, but movement of the user support is dependent on and linked to the movement of the user engagement means. Movement of the user engagement means may be rotational or may be in a linear exercise path, as described in pending U.S. patent application Ser. No. 10/633,805 entitled "Self-Aligning Pivoting Seat Exercise Machine" which was filed on Aug. 4, 2003, the contents of which are incorporated herein by reference.

An exercise machine in another embodiment has a frame with a base on which a user support and user engagement device or exercise arm are mounted for performing an exercise, and a weight stack housing containing a weight stack for providing selected resistance to an exercise movement. The weight stack housing is selectively mountable either on the left hand side or the right hand side of the user support, based on user preference or on space constraints. This can allow several machines to be mounted closer together by alternating the side on which the weight stack is mounted, for example.

According to another aspect, an exercise machine has a user support pivotally linked to the frame at two spaced positions. The first pivotal linkage is a floating link which is pivotally connected to the user support at a first location and pivotally connected to the frame at a second location below the user support. A second pivotal linkage is spaced forward from the floating link. A movable user engagement device or exercise arm is linked to the user support or a pivotal mount for the user support so that movement of the exercise arm translates to movement of the user support. The floating pivotal link is configured to move in a first direction during a first stage of an exercise movement, then to float in the same position during a second stage of the movement, and finally to reverse direction and move back in a second direction opposite to the first direction during a final stage of the exercise movement.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for a chest press exercise machine with a self-aligning pivoting seat or user support.

After reading this description it will become apparent to one skilled in the art how to implement the invention in various alternative embodiments and alternative applications. However, although various embodiments of the present invention will be described herein, it is understood that these embodiments are presented by way of example only, and not limitation.

FIGS. 1 to 8 illustrate a first embodiment of a chest press exercise machine 10. The machine is used to perform an exercise equivalent to a vertical bench press and allows a user to perform an exercise movement known as a supine press which is the chest to chin movement of a barbell press.

Figure 1:
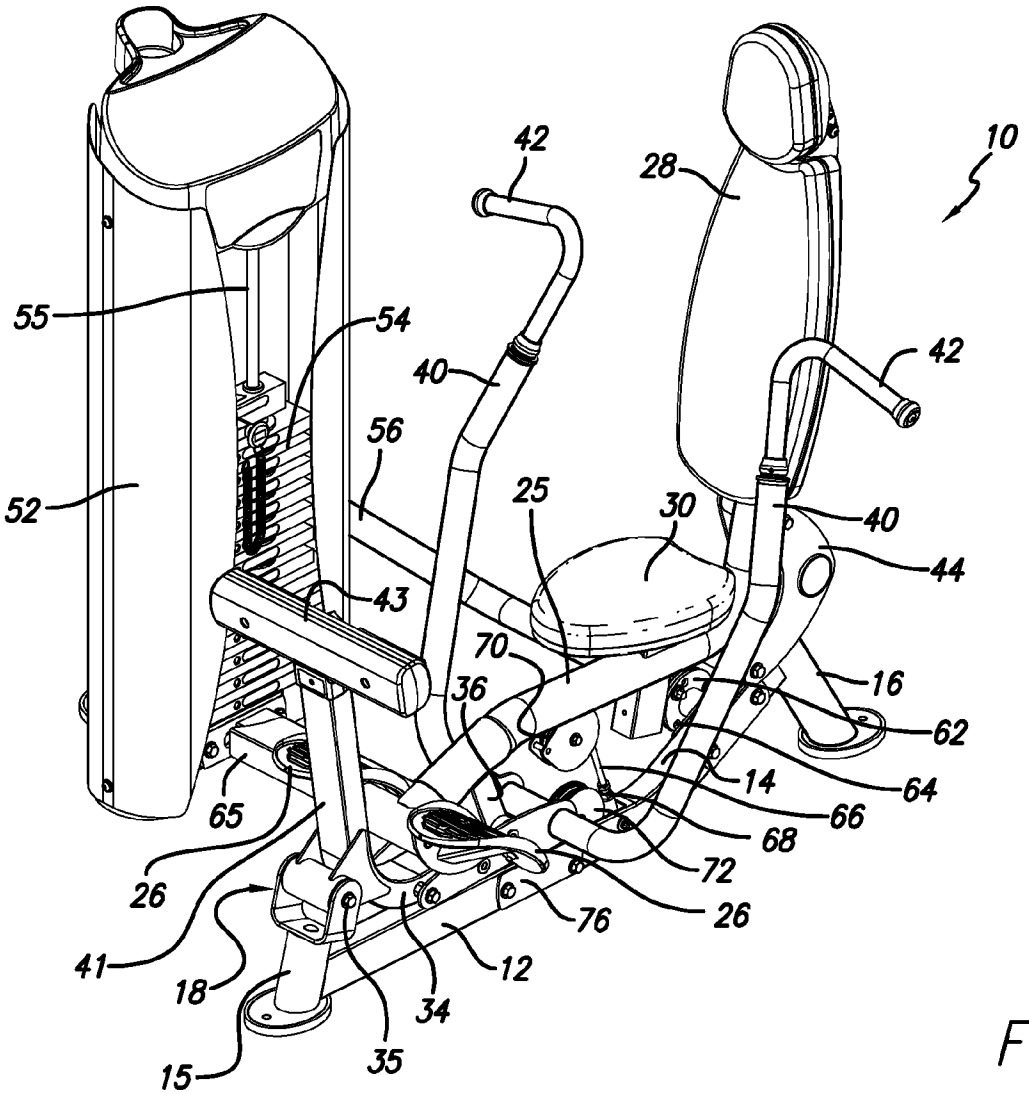
FIG. 1 is a front perspective view of a chest press exercise machine according to a first embodiment.

Exercise machine 10 has a main frame comprising a horizontal base tube 12 with an upwardly angled rear end 14. Front and rear inwardly inclined uprights or posts 15,16 are positioned at each end of the base tube. A first pivot mount 18 is located atop the front post or upright 15, as illustrated in FIG. 1. A second pivot mount is located on top of a standoff 20 located on base tube 12 approximate its rearward end, as illustrated in FIGS. 1, 5 and 6.

A generally "L" shaped user support frame 22 has a backrest section 24, an elongated seat section 25 and a footrest 26 mounted at the forward end of the seat section. A back pad 28 and seat cushion 30 for supporting an exerciser are mounted on the user support frame to complete the user support. The seat cushion 30 is adjustable relative to the user support frame 22 by means of telescoping adjustment mechanism 32 to vary the distance between the user engaging handles and the seat to accommodate users of varying heights. Adjustment mechanism 32 may extend be mounted through seat section 25 of the support frame, as illustrated in FIGS. 1 to 4, 7 and 8, or may be mounted to one side of the seat support section of the frame, as illustrated in FIGS. 5 and 6.

Figure 2:
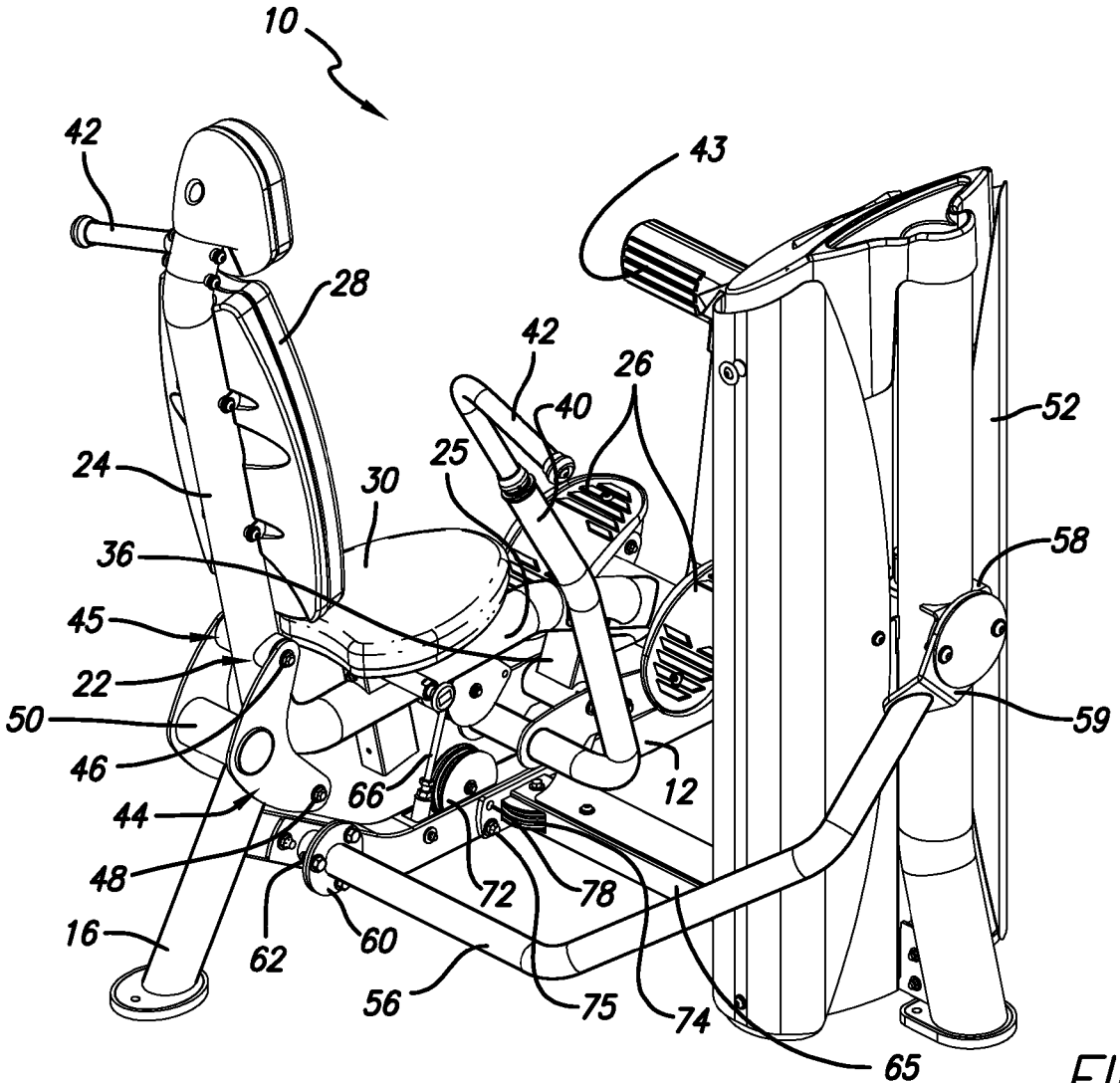
FIG. 2 is a rear perspective view of the exercise machine of FIG. 1.
Figure 3:
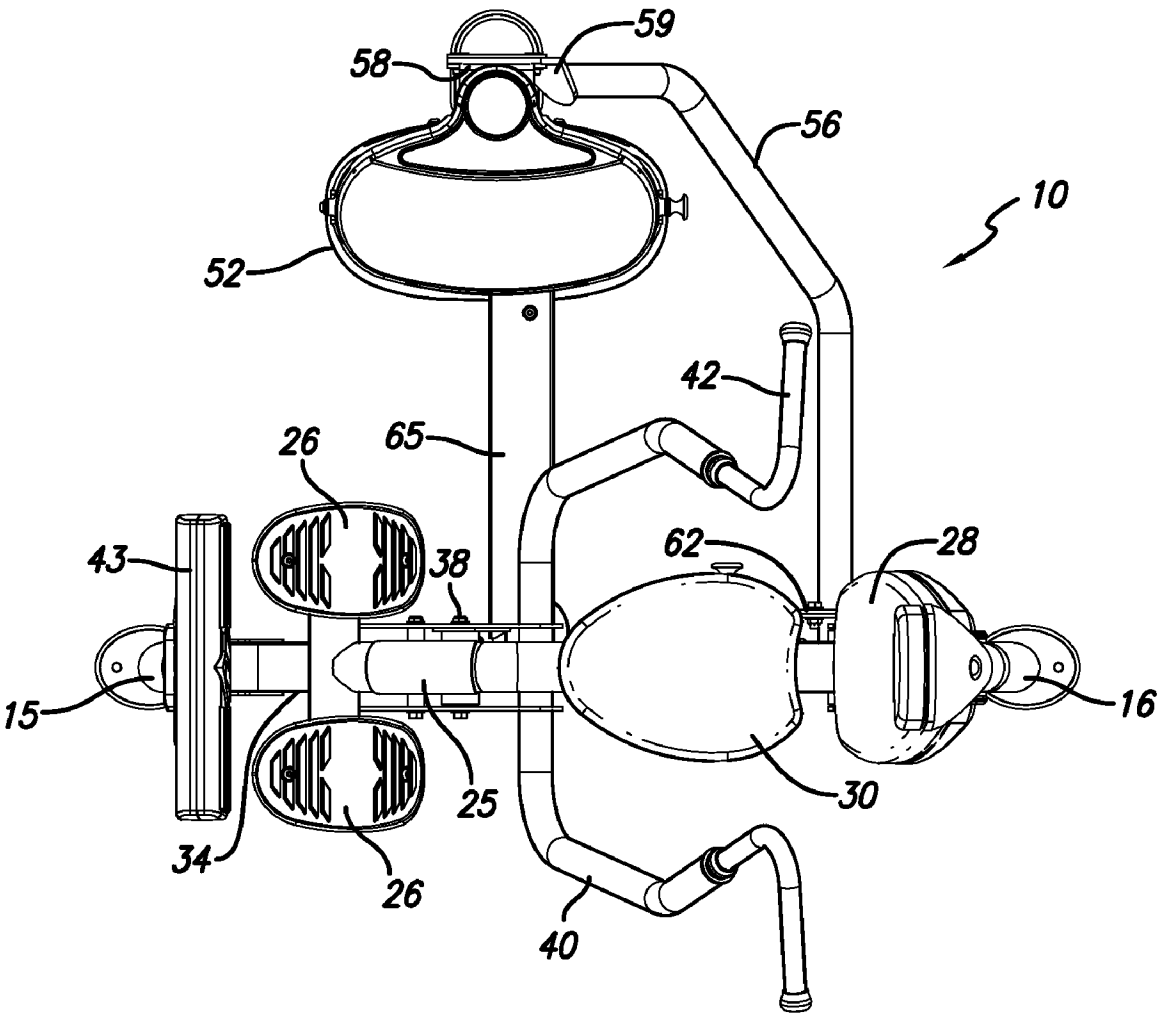
FIG. 3 is a top plan view of the exercise machine of FIGS. 1 and 2.
Figure 4:
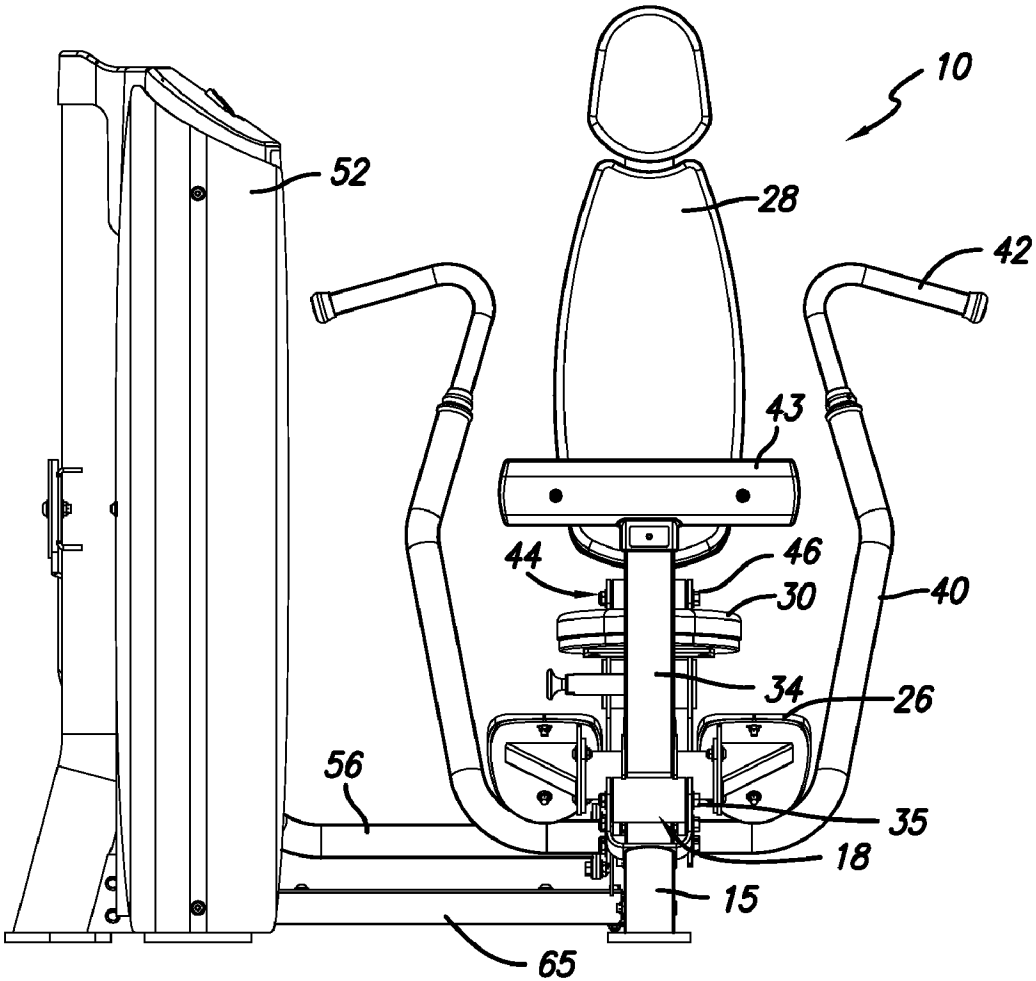
FIG. 4 is a front elevation view of the exercise machine of FIGS. 1 to 3.

A generally L shaped connecting link 34 is pivotally mounted on the front pivot mount 18 of the frame at a location close to the junction or bend between the two portions of the L-shape, for rotation about a pivot axis 35. Connecting link 34 is also pivotally attached to a pivot mount on a standoff 36 mounted on the underside of the elongated seat section 25 of the user support for rotation about a second pivot axis 38. A user engaging exercise arm or device is secured at or adjacent a rear end of the generally horizontal portion of the L-shaped connecting link 34 and rotates with the link about pivot axis 35. As illustrated in FIGS. 1 and 2, the user engaging device comprises a pair of exercise arms 40 extending upwardly on opposite sides of the user support and having outwardly bent handles or grips 42 at their upper ends. Upright leg 41 of the L-shaped connecting link extends upward from pivot mount 18 and comprises a positioning device to control the position of exercise arm device 40. A foot engaging cocking mechanism 43 is transversely mounted at the top end of the upright leg 41 of the connecting link 34 and is designed to assist the user in bringing the user engaging handles 42 of the exercise arm into the desired position, as described below in connection with FIG. 5.

The user support is pivotally connected to the main frame at two points. The first pivotal connection is a "floating link" 44 that joins the pivot mount on standoff 20 at the rear end of the base tube 12 with a pivot mount 45 located on the upright backrest section of the user support. The second pivotal connection is provided by the connecting link 34 which joins the forward pivot mount 18 on the main frame with the pivot located on stand-off 36 mounted on the underside of the elongated seat section of the user support. The connecting link therefore serves to link movement of the user engagement means or exercise arm to movement of the user support, and also acts as a pivoting link between a forward portion of the user support and the main frame.

As best illustrated in FIG. 2, floating link 44 comprises a pair of spaced plates which are each of a generally rounded V-shape and are pivotally attached to the pivot mount 45 at one end for rotation about a first pivot axis 46 just below backrest 28 and pivotally attached to the pivot mount on standoff 20 on the base tube 12 for rotation about a second pivot axis 48. The second pivot axis is fixed while the first pivot axis 46 moves with the user support. The two plates are joined together at the apex of the V-shape by a connecting post or rod 50.

A vertical weight stack support frame 52 is connected to the main frame and houses a selectorized weight stack 54 running on two guide rods 55. A cable and pulley system connects the elongated seat section of the user support with the weight stack to provide resistance to movement by the user support. The weight stack and support frame are releasably secured on one side of the main frame in a manner which allows the weight stack and frame to be selectively positioned on either side of the main frame. As best illustrated in FIGS. 1 to 4, a connecting rod 56 has a first end releasably bolted to a mounting plate or stand-off 58 on the outer face of frame 52 via angled mounting bracket 59 and a second end having a mounting plate 60 releasably bolted to a corresponding mounting plate 62 on a stand off on one side of base tube 12 adjacent its rear end. As can be seen in FIG. 1, mounting plate 62 on the base tube has a larger number of mounting holes 64 than mounting plate 60. Also extending between the base tube 12 and the weight stack is a guide tube 65 for the cable and pulley system, as will be explained in more detail below.

Part of the cable and pulley system which links the exercise movement to the selected resistance provided by weight stack 54 is illustrated in FIGS. 1, 2 and 5. As illustrated in FIGS. 1 and 5, cable 66 extends from an anchor 68 on the base tube 12, around a first pulley 70 on the underside of the extended seat portion 25 of the user support frame, back around a second pulley 72 on the base tube 12, and then around a perpendicular pulley 74 (see FIG. 2) at the end of horizontal guide tube 65. The horizontal guide tube 65 is releasably secured to the side of base tube 12 via bolts 75. Cable 66 may be linked to the weight stack through guide tube 65 via additional pulleys and cables in any suitable manner.

Figure 7A:
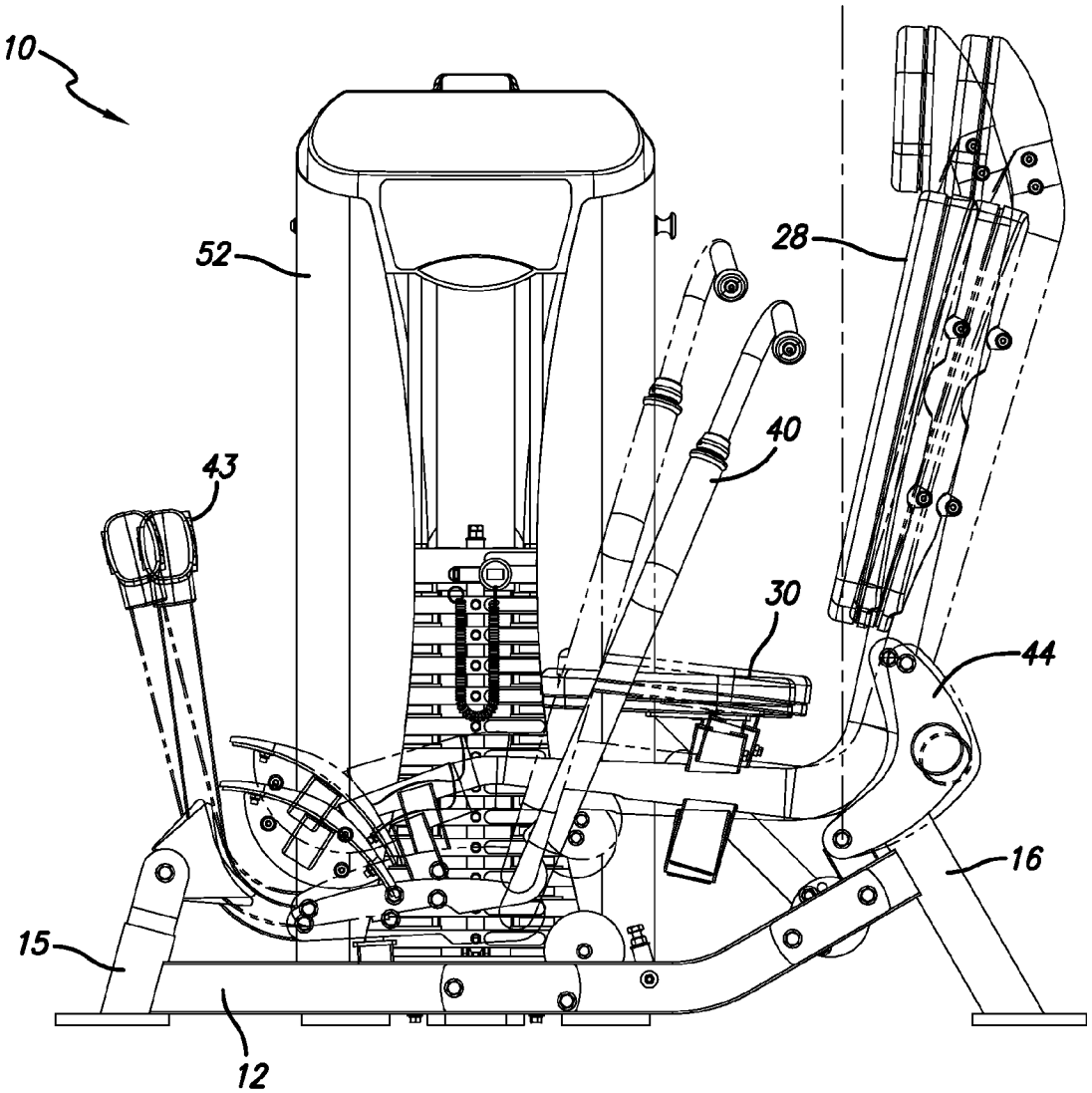
FIGS. 7A to 7G are side elevational views illustrating a sequence of positions of the moving parts of the chest press machine of FIGS. 1 to 6 between the start position of FIG. 5B and the finish position of FIG. 5C.
Figure 7B:
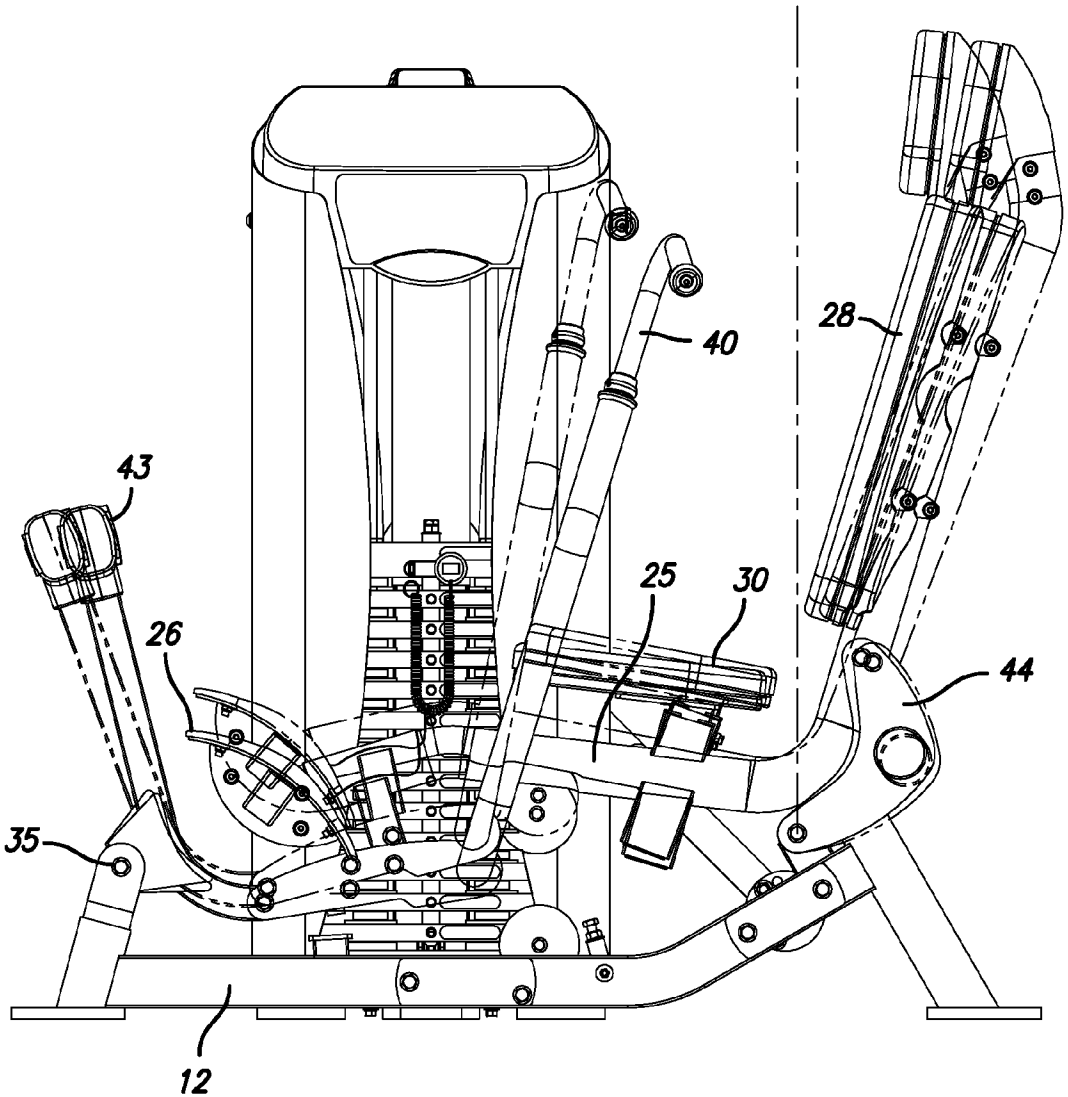
Figure 7C:
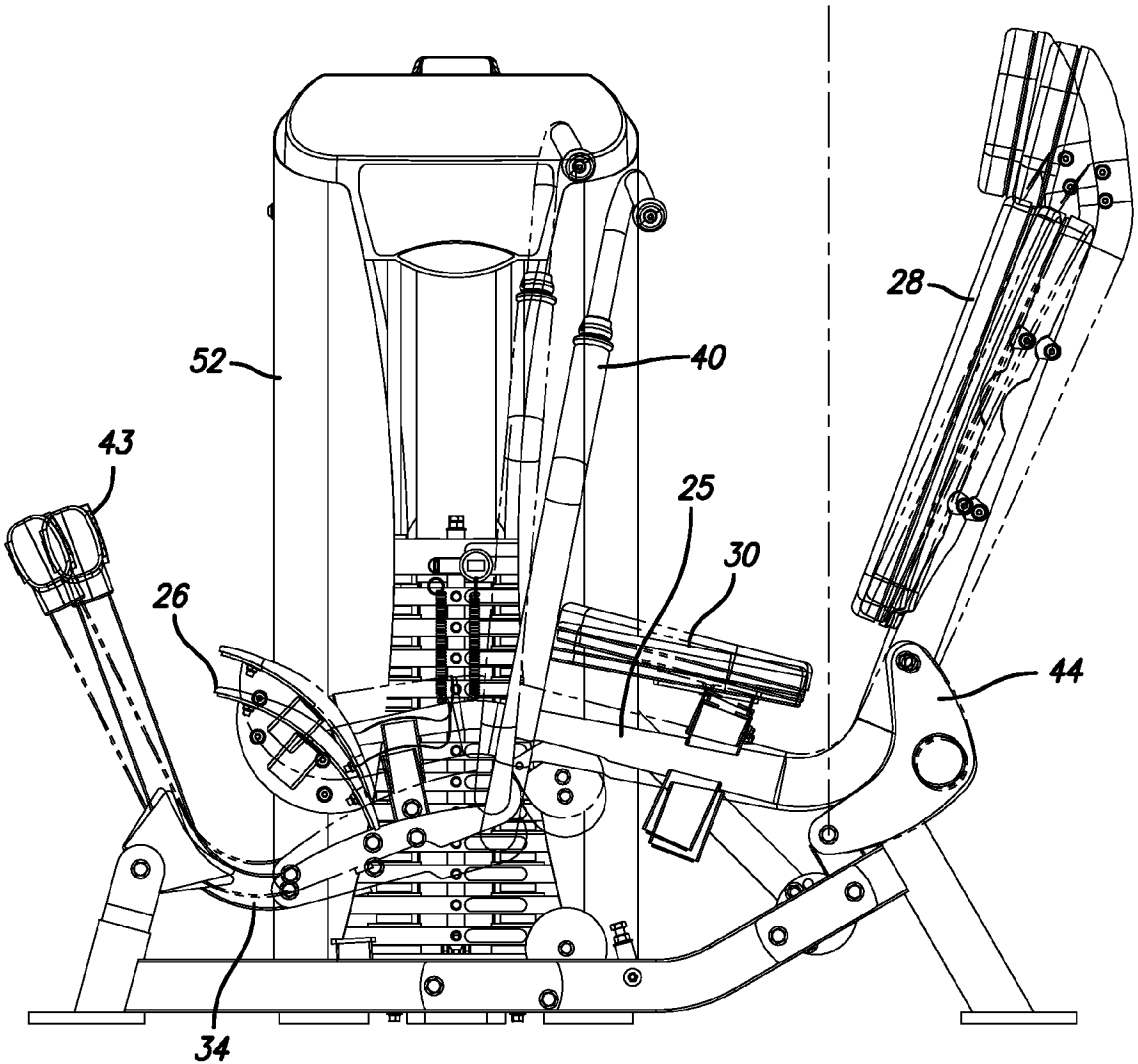
Figure 7D:
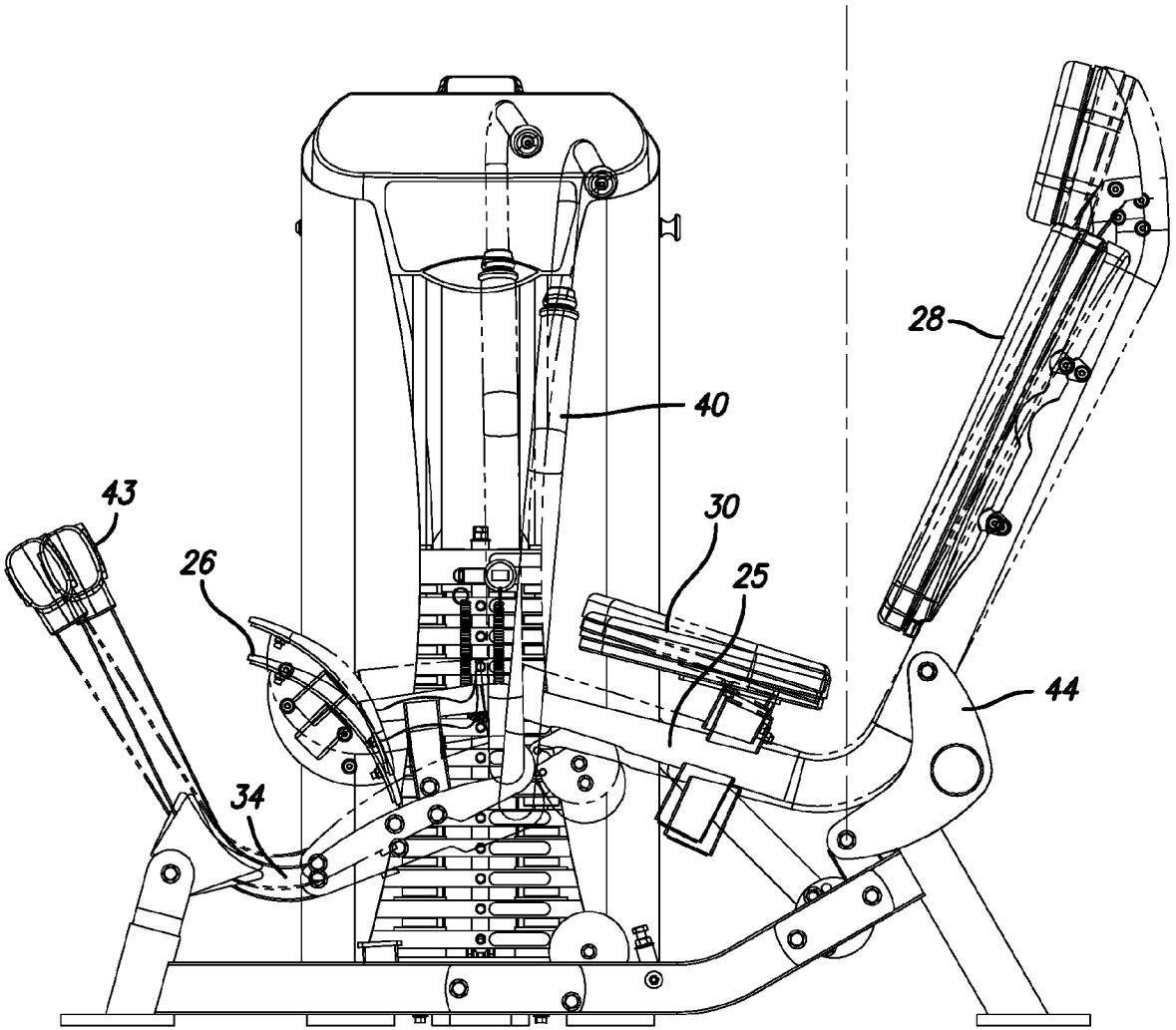
Figure 7E:
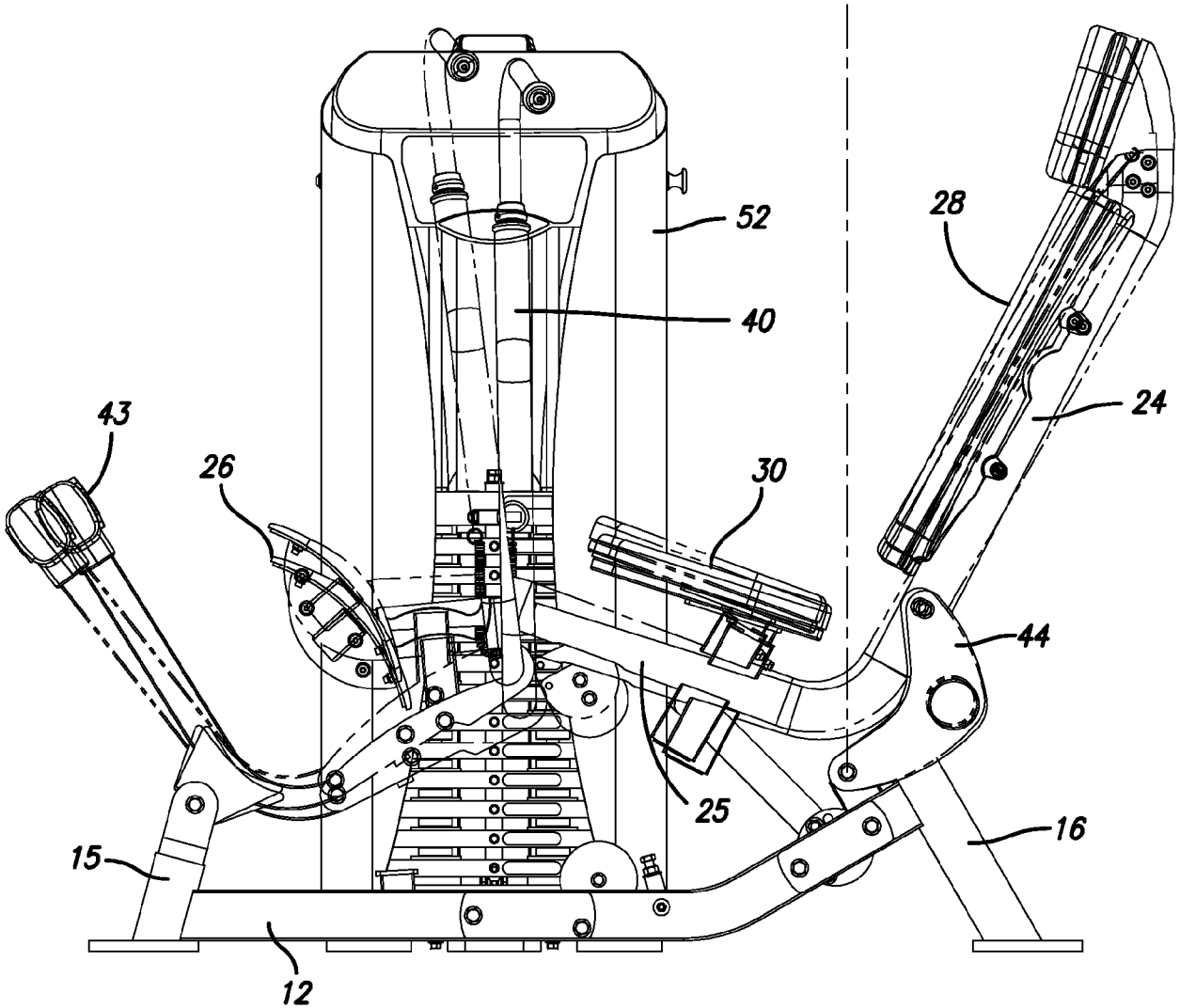
Figure 7F:
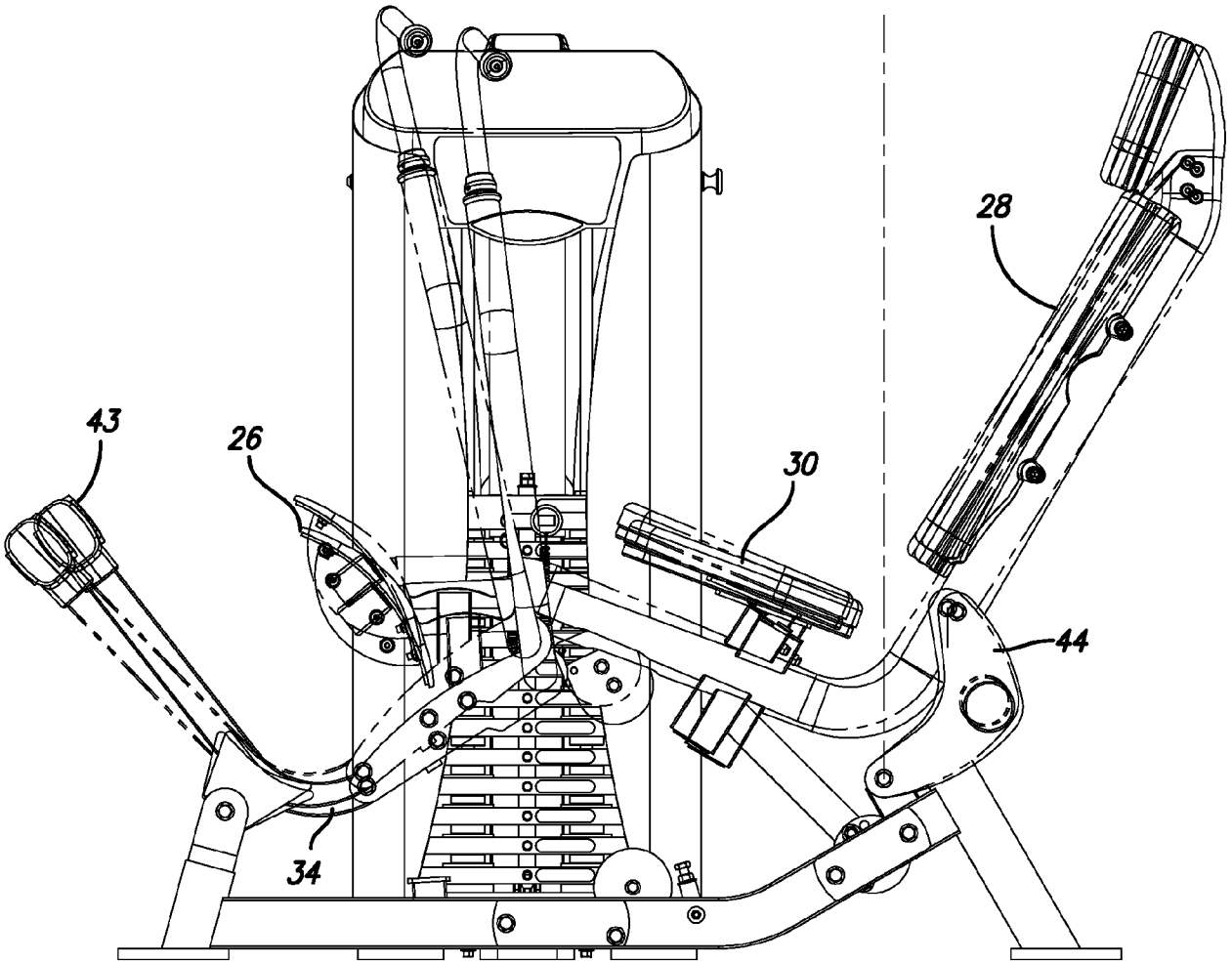
Figure 7G:
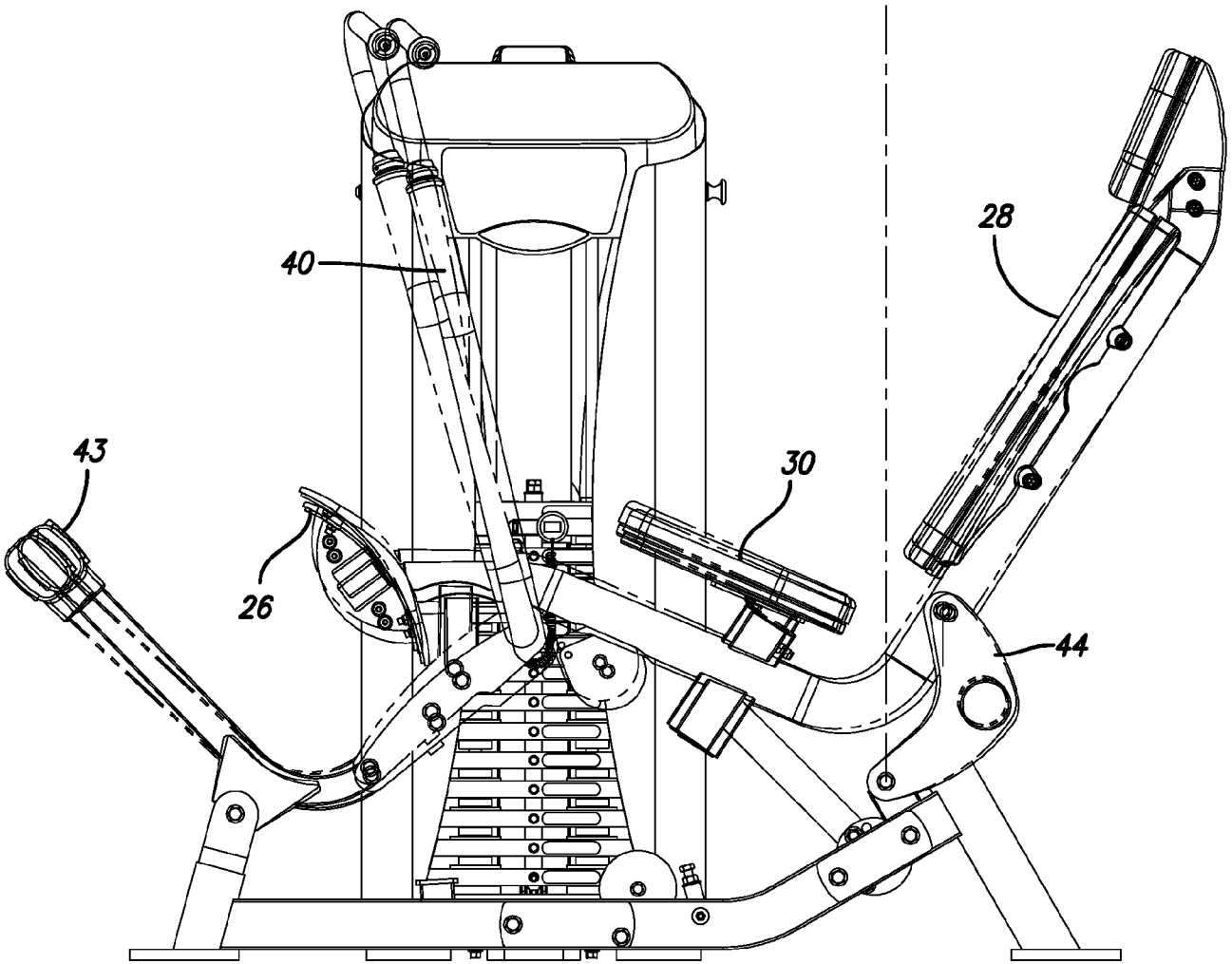
Figure 8:
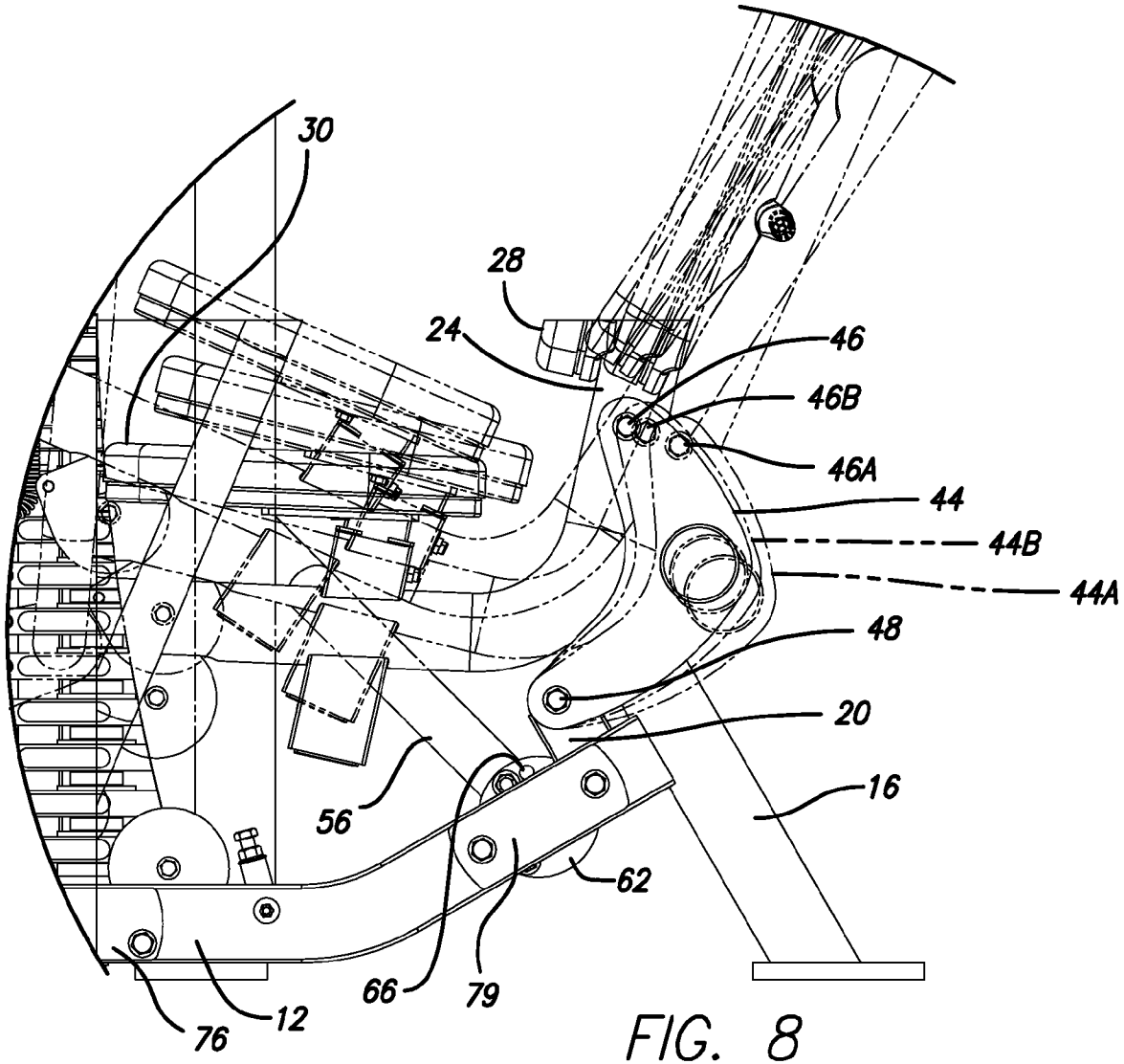
FIG. 8 is a close up view of the floating link of the machine of FIGS. 1 to 7, illustrating three different positions of the floating link during an exercise movement.

If a user or machine owner wishes to position the weight stack on the opposite side of the machine to that illustrated in FIGS. 1 to 8, the connecting rod 56 is first unbolted from the side of base tube 12 and from the rear mounting plate 58 on the weight stack frame 52. Guide tube 65 is unbolted from the side of base tube 12 as well, and the cable 66 is released from the remainder of the cable and pulley system in tube 65 in any suitable manner. Cover plate 76 is unbolted from the opposite side of base tube 12 (FIG. 1), and mounting plate 62 and the attached stand-off are removed from the first side of the base tube and secured on the opposite side in place of cover plate 79 (FIG. 8). The weight stack frame is then moved to the opposite side of the machine and the mounting plate 78 at the end of guide tube 65 is secured to the second side of the base tube where cover plate 76 was previously located. Cable 66 is re-connected to the cable and pulley system through tube 65. The connecting rod 56 is re-secured to the rear mounting plate 58 on the weight stack to extend from the opposite side of housing 52 and is connected at its opposite end to the mounting plate 62. The additional mounting holes 64 in mounting plate 62 allow for the different angle of approach of connecting rod 56 as a result of the reversal in direction.

By allowing the weight stack housing to be mounted on either side of the exercise machine, the user or owner of the machine can select which side is best for locating the weight stack, based on user preference or space constraints. If several such machines are to be located in a common area, the weight stack housing on one machine can be on one side and the next machine can have the weight stack housing on the opposite side, so that the machines can be staggered and the weight stacks positioned adjacent one another. This allows machines to be positioned closer together so that they take up less floor space.

Figure 5A:
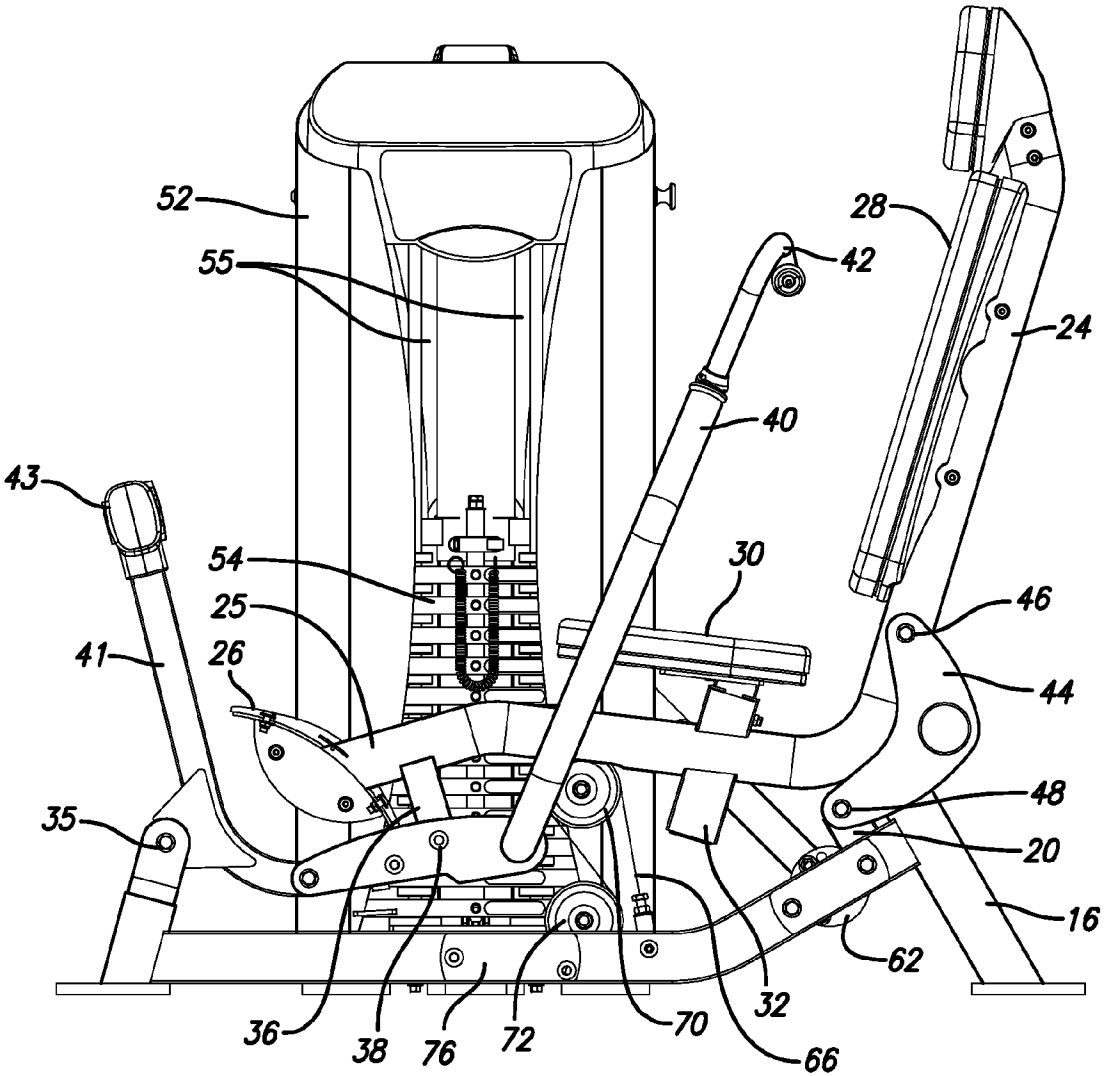
FIG. 5A is a side elevation view of the chest press exercise machine of FIGS. 1 to 4 in a rest position.
Figure 5B:
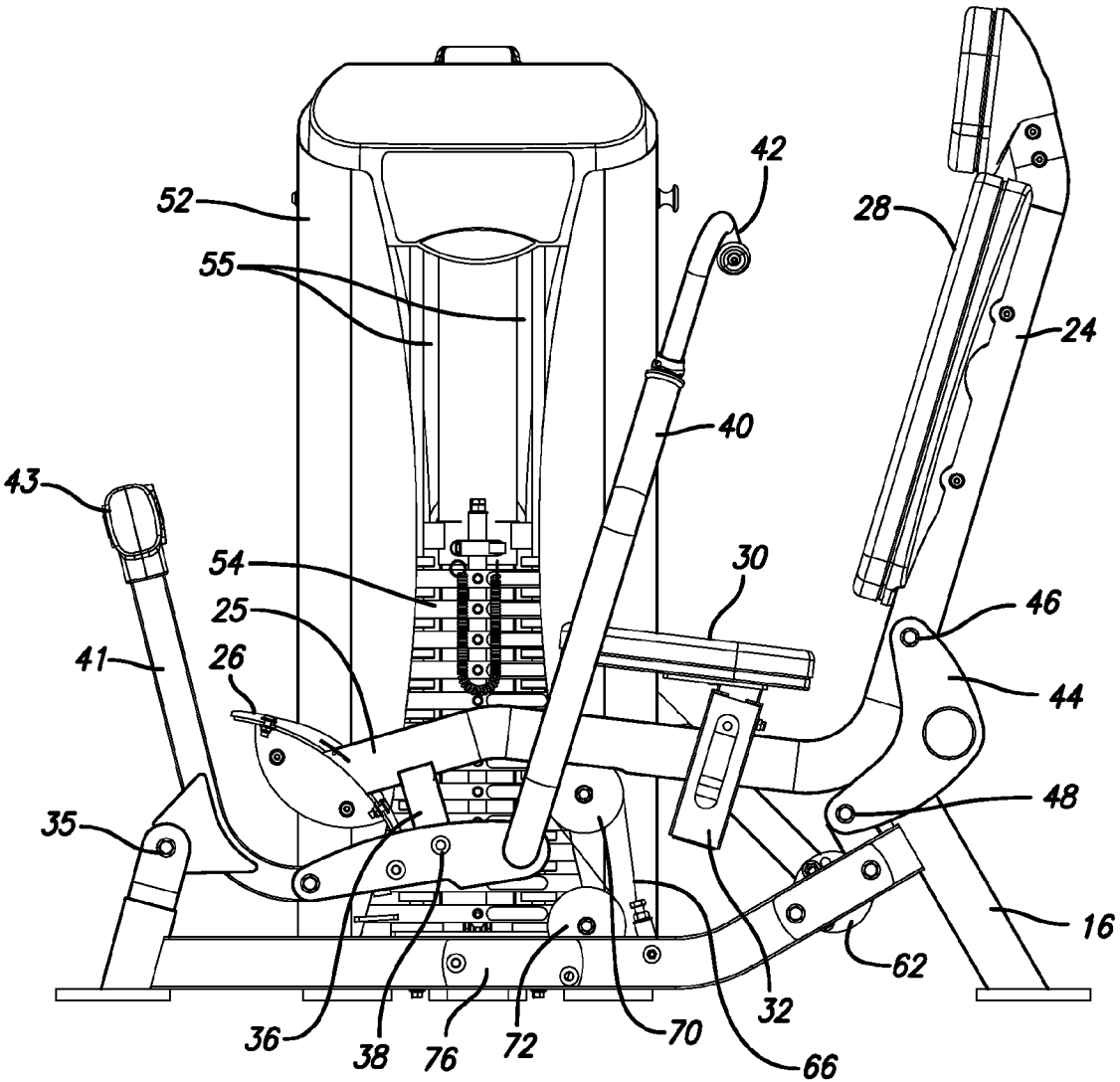
FIG. 5B is a side elevation view similar to FIG. 5A but illustrating a start or exercise ready position for a chest press exercise.
Figure 5C:
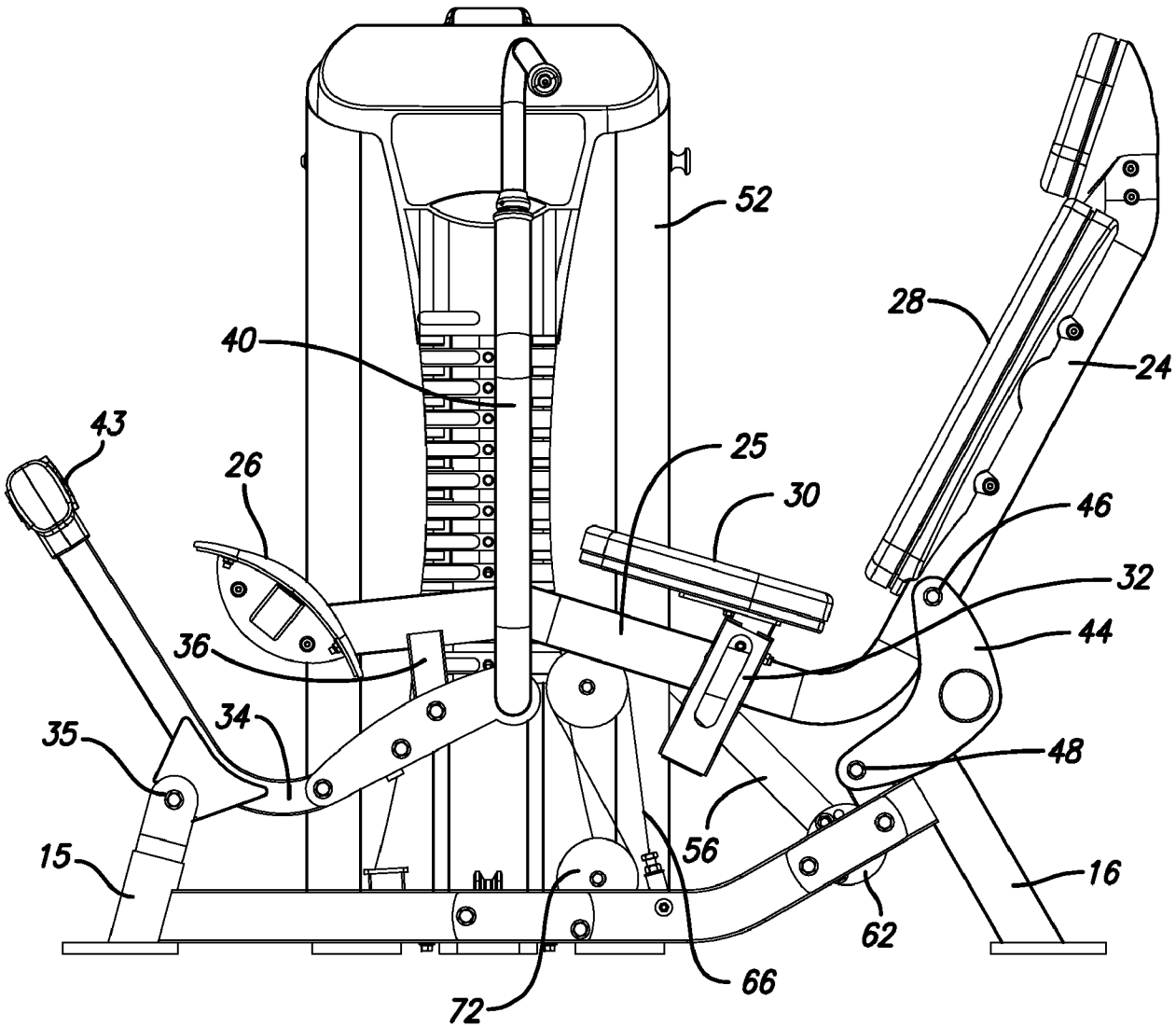
FIG. 5C is a side elevation view similar to FIGS. 5A and 5B but illustrating a finish position for a chest press exercise on the machine.
Figure 6A:
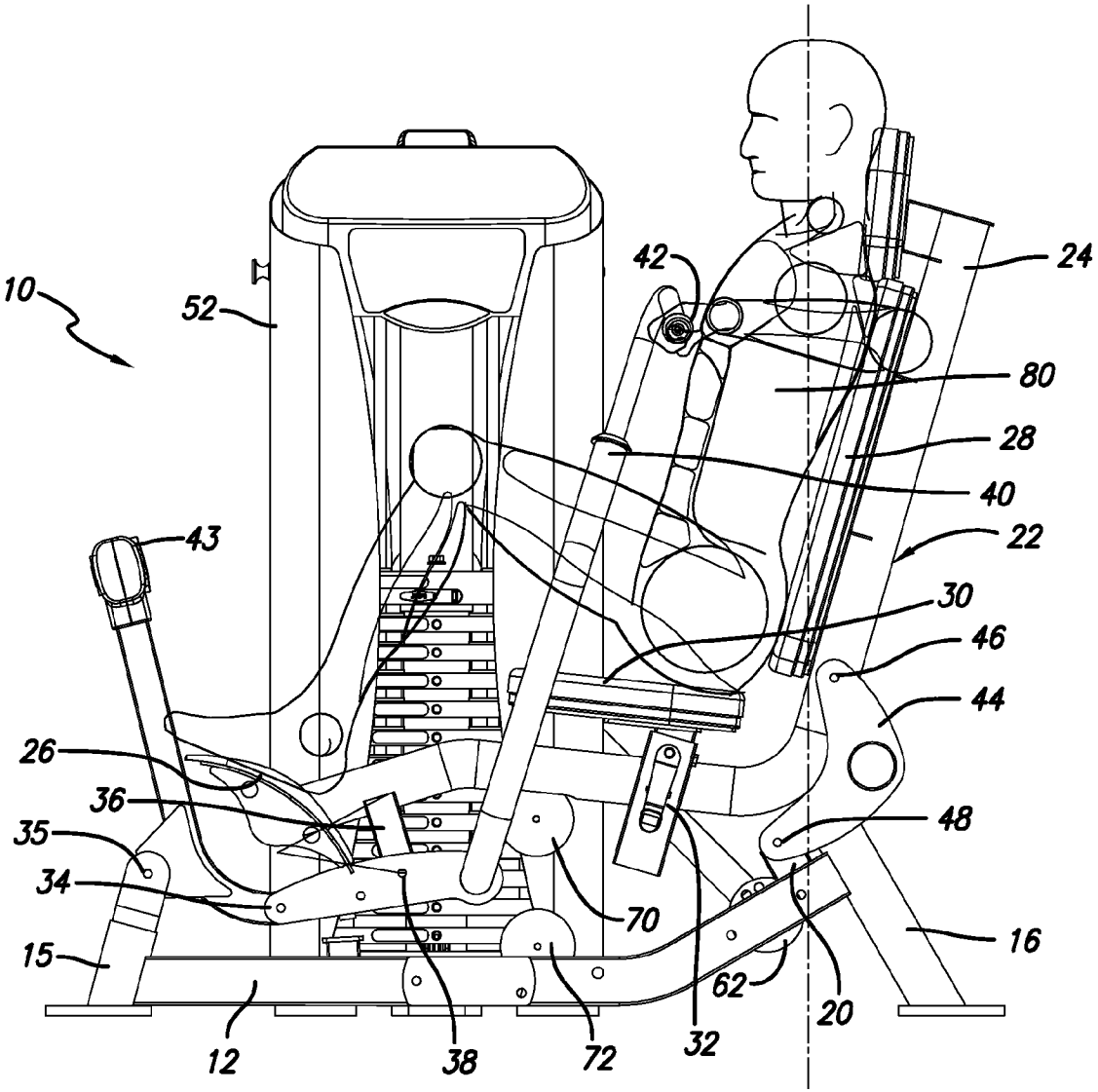
FIGS. 6A and 6B are views similar to FIGS. 5B and 5C but illustrating a seated exerciser performing a chest press exercise on the machine.
Figure 6B:
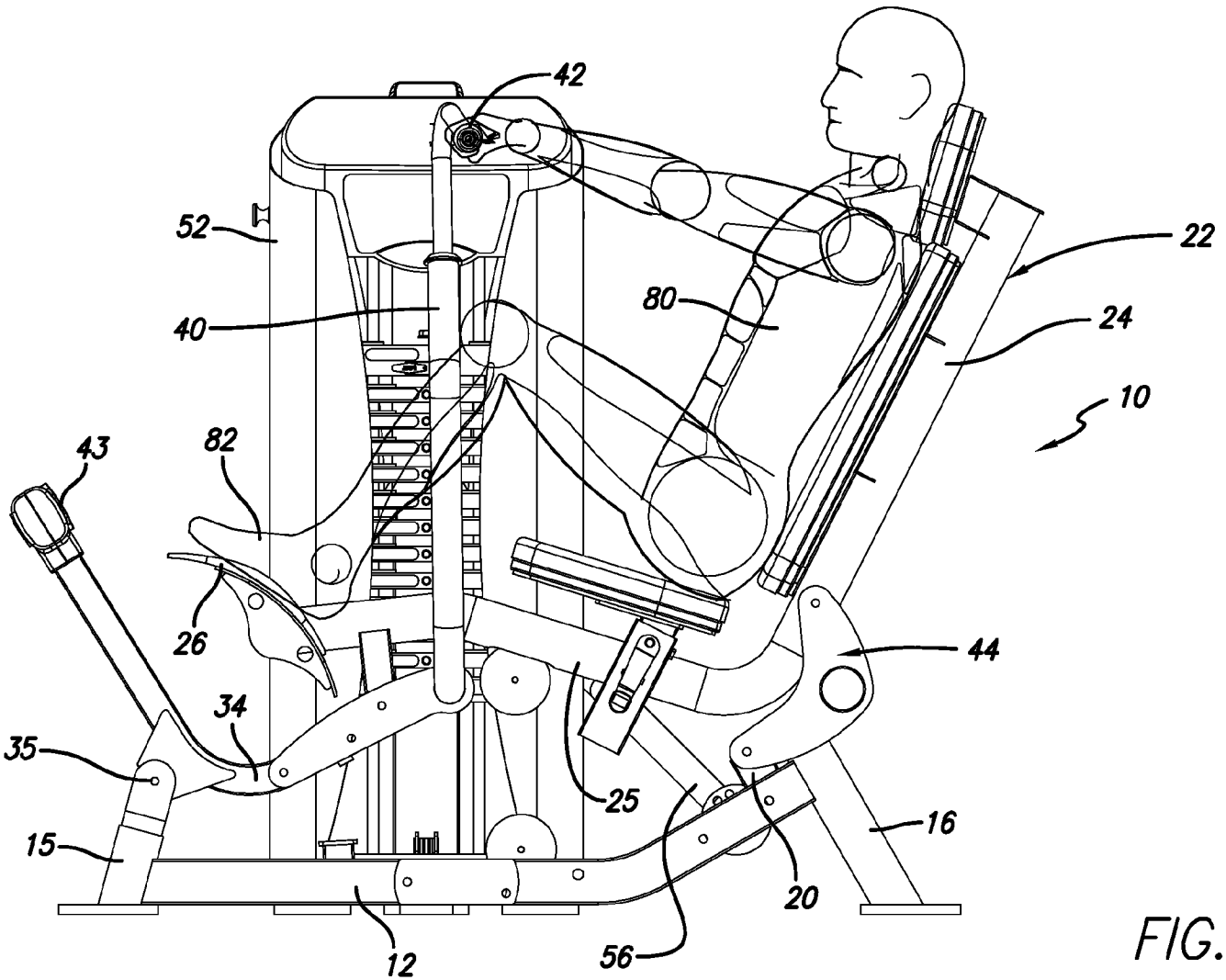

When the machine is not in use, the exercise arm 40 is in the rest position of FIG. 5A. To perform a chest press exercise, the user is positioned on the seat with their back against the back pad and their feet on the foot rest. They then place their feet on the transverse assist bar or exercise arm positioning mechanism 43 and push it forward. Because both the assist bar and exercise arm are part of the connecting link 34, forward movement in the assist bar 43 forces link 34 to pivot about pivot axis 35 at its connection to the main frame. This also rotates the exercise arms 40 forward and lifts the front end of the user support 22 upward, which causes the user support to rotate rearward about its connection to the main frame via the floating link 44. This action brings the user engaging handles 42 on the exercise arm into the proper, exercise ready starting position, which is illustrated in FIGS. 5B and 6A, with FIG. 6A illustrating a user 80 seated on the user support seat in an exercise starting position. The exercise arm positioning device 41, 43 in this embodiment moves both the exercise arm and the user support when activated to control the exercise start position. Once the exercise arm is in the exercise ready or start position, the user 80 grabs the handles 42, returns their feet 82 to the foot rest 26 on the user support and proceeds to exercise by pressing the handles forward. As the connecting link 34 rotates forward, the user engaging handles 42 travel forward in an upward arc while the user support 22 pivots upward at its forward end and rearward. This combined action results in placing the handles 42 at approximately chin level in the finish position of FIGS. 5C and 6B, and mimics the natural chest to chin exercise movement of the free weight exercise.

Throughout the entire exercise motion, the pivoting seat and backrest or user support continuously and automatically self-align to the movement of the exercise arm. This combined movement maintains a desirable alignment relationship between the exerciser, positioned on the user support, and the user engaging device (handles) on the exercise arm. This machine provides a starting and finishing alignment between the user and machine, and the combined motion of user support and the exercise arm is similar to the natural, gradual arcing arm movement of a traditional free weight exercise.

The exercise machine of FIGS. 1 to 8 places the user in a back supported starting position with their hands at chest level, then follows the slight natural arcing movement of a barbell or dumbbell press and ends with the user's arms extended out away from their body at the appropriate position for the exercise. Because the user support moves in conjunction with the exercise arm, the arcuate path of the exercise arms relative to the user support is reduced. The result is a more natural feeling exercise movement that more closely replicates the movement found in the corresponding free weight exercise. Because the seat and back pad move together, the user remains in position relative to the exercise arm with back support throughout the exercise, and can balance properly with little or no effort.

The floating link 44 which provides a pivotal link between a rear portion of the user support and the main frame helps to ensure a proper arcing motion of the user support throughout the exercise movement. FIGS. 7A to 7G illustrate successive stages in the exercise movement from the start position shown in solid line in FIG. 7A and the finish position shown in dotted line in FIG. 7G. In these drawings, the bold or solid outline represents the machine in a first position while the dotted outline represents the end position for that incremental movement sequence. In the next sequence the bold or start position is the same as the dotted or end position of the previous drawing. This helps to illustrate exactly how the floating link moves throughout the exercise. The floating link 44 starts off rotating rearward as the user support is tilted by the movement of the exercise arm and connecting link. This rearward rotation continues through the positions in FIGS. 7A, 7B and 7C. In FIG. 7D, the floating link 44 stops and floats, suspended in place as exercise arm 40 continues moving forward. In FIG. 7E, the link 44 starts to rotate in a forward direction and the forward rotation continues while the exercise arm is still moving forward in FIGS. 7E, 7F, and 7G.

Thus, FIGS. 7A to 7C show the first or rearward stage of the floating link movement, FIG. 7D shows the second or floating stage and FIGS. 7E to 7G show the third or forward stage as the link reverses direction. This movement sequence is measured by degrees of rotation to the exercise arm and horizontal distance that the two pivot axes 46 and 48 of the floating link move apart. For example, in FIG. 7A the exercise arm moves from 82 to 76 degrees (6 degree change) while the two pivot axes 46 and 48 move from a horizontal spacing of 2.67 to a horizontal spacing of 3.71 inches (1.04 inch change). In FIG. 7B, the starting point for arm rotation is 76 degrees while the starting distance or horizontal spacing for measuring link movement is 3.71 inches, while the ending point for arm rotation is 70 degrees and the ending horizontal separation between pivots 46 and 48 is 4.37 inches. The horizontal spacing or separation between the floating link pivot axes continues to increase in FIG. 7C, ending at around 4.68 inches, while the arm rotates to 64 degrees. It can be seen in FIG. 7D that there is no change in the position of the link (the horizontal spacing between the pivot axes is about the same at the start and finish position in FIG. 7D), yet the arm has rotated forward from the position in FIG. 7C through another six degrees. In FIG. 7D, it can be seen that the floating link reverses direction and rotates forward so that the separation between the pivot axes is reduced, while the arm continues to rotate forward. This forward rotation of the arm and the floating link continues through FIGS. 7E and 7F.

FIG. 8 is a close up of the floating link 44 with overlapping views of the position of the link in FIGS. 7A, 7D and 7G. The start position of FIG. 7A is shown in solid outline, while the furthest rearward position of FIG. 7D is shown in dotted outline as 44A in FIG. 8, and the finish position 44B is also shown in dotted outline in FIG. 8. This illustrates the amount of movement of the floating link throughout the exercise movement. The link moves from position 44 to position 44A, then back from position 44A to the finish position 44B, and the corresponding positions of the pivot axis are shown at 46, 46A, 46B. This illustrates how the floating pivot reverses in direction while the exercise arm rotated in one direction.

The floating link 44 of this embodiment may be used as a primary pivotal mount for a user support in other types of exercise machine where movement of an exercise arm is linked to movement of a user support, including the embodiments described below for performing various types of chest press exercise, and machines for performing other types of exercise.

FIGS. 9 to 14 illustrate a chest press machine 90 according to another embodiment. This machine is designed to perform an incline-type chest press or so-called incline-press exercise. The machine has a main frame comprising a horizontal base section 92 and an upright section 94. An angled brace tube 95 reinforces the connection between the base and upright sections. A first pivot bracket 96 is mounted at or adjacent the upper end of upright section 94. A second pivot bracket 98 is mounted on the brace tube at an intermediate position.

Figure 9:
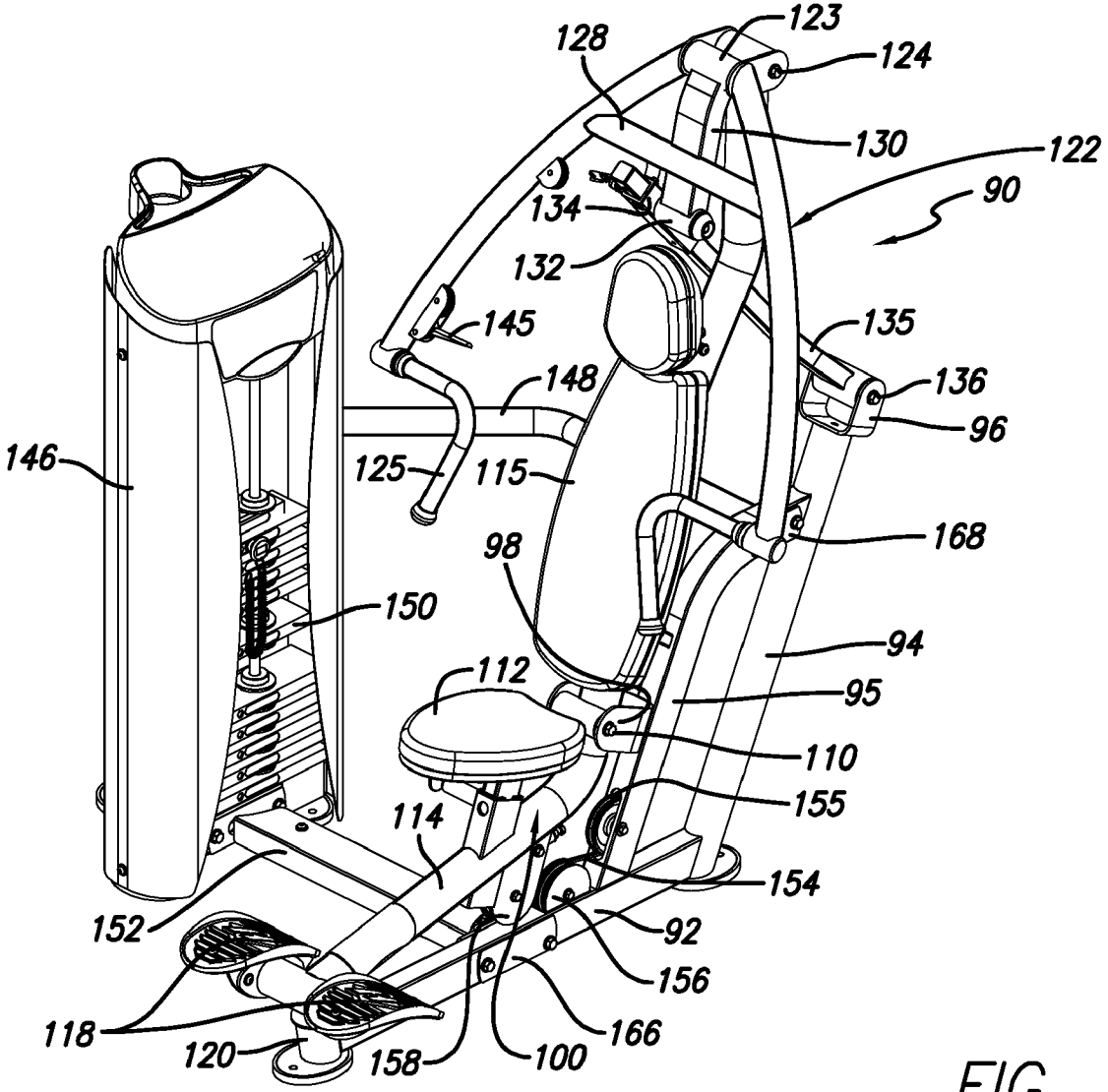
FIG. 9 is a front perspective view of an incline-type chest press exercise machine according to a second embodiment.
Figure 10:
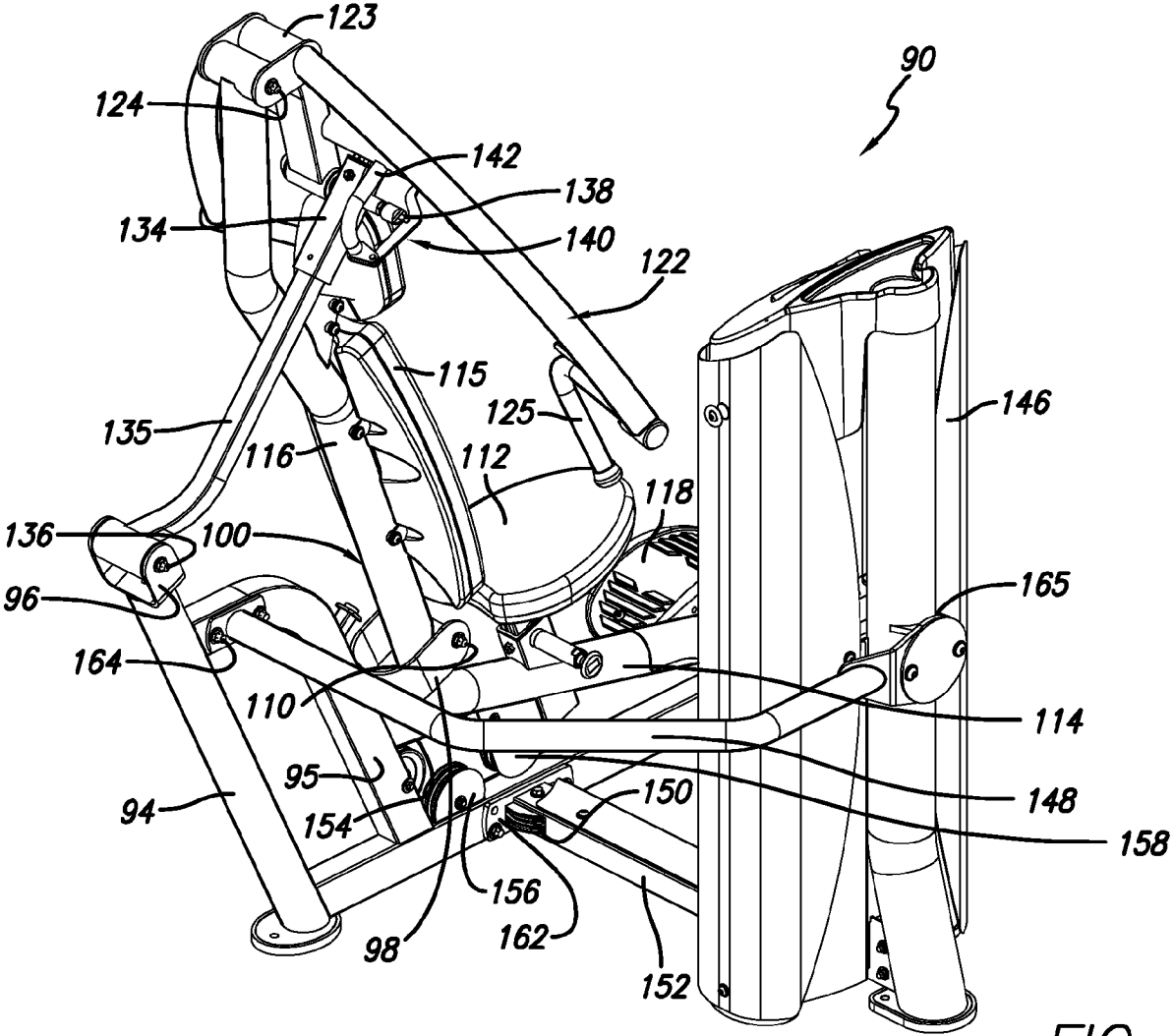
FIG. 10 is a rear perspective view of the exercise machine of FIG. 9.
Figure 13A:
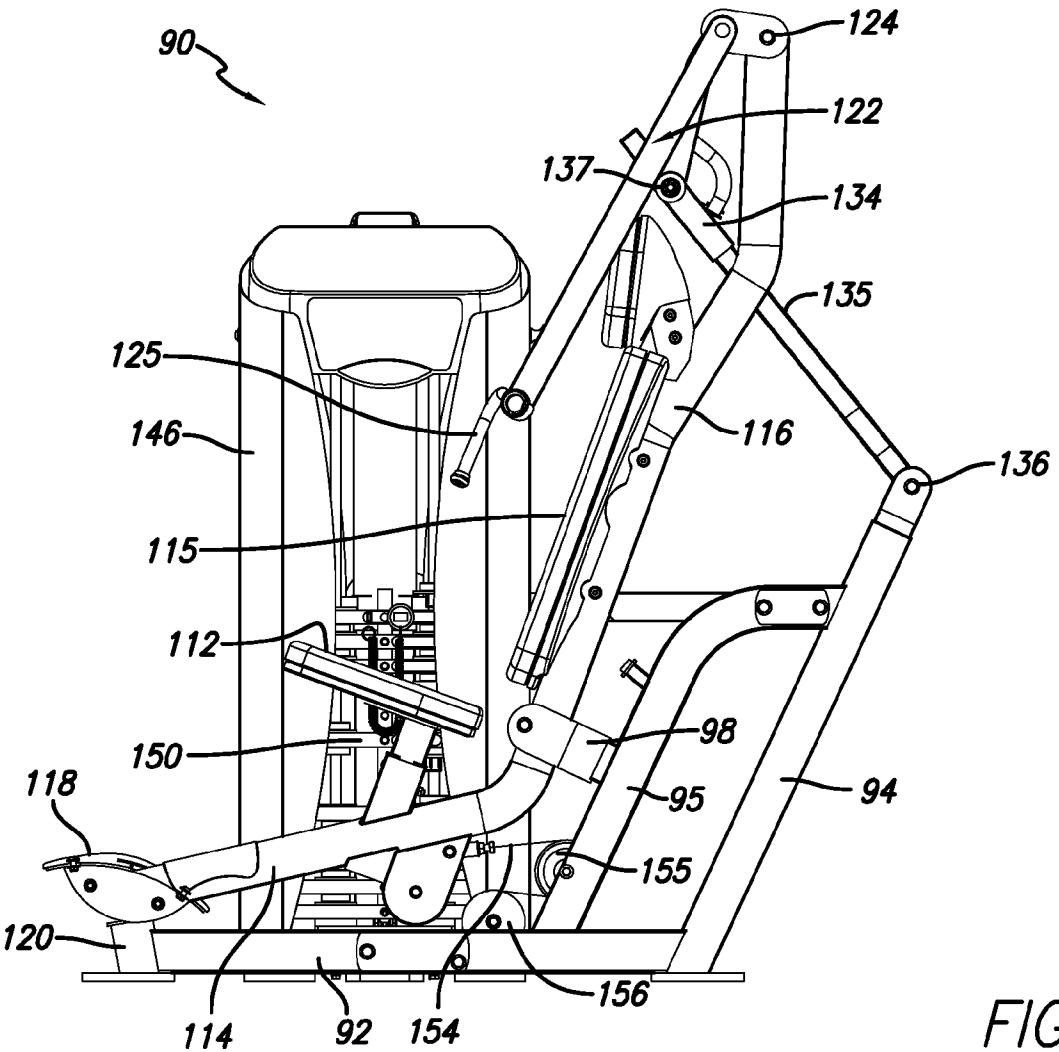
FIG. 13A is a side elevation view of the exercise machine of FIGS. 9 to 12 in a start position for an incline press exercise.
Figure 13B:
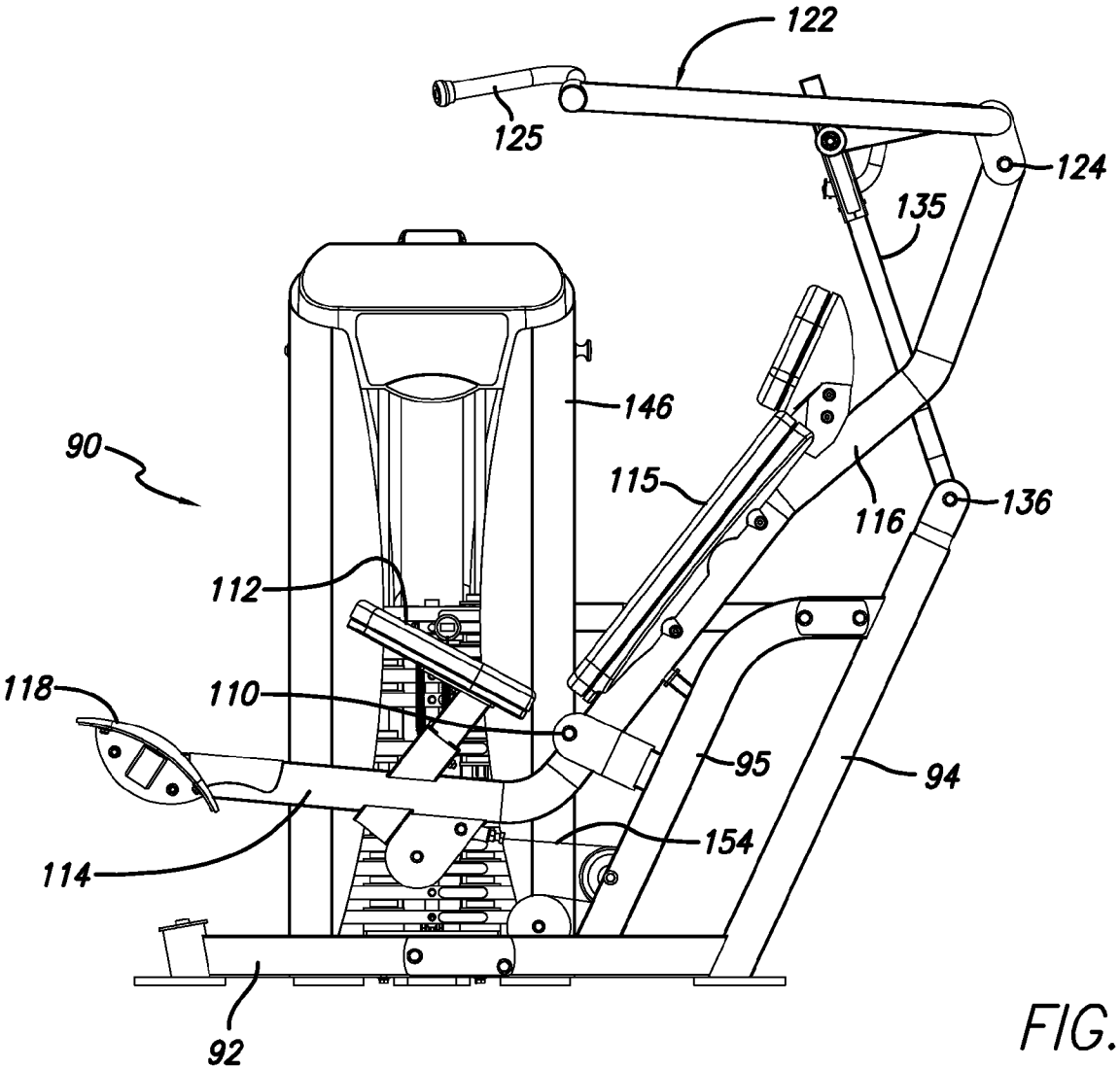
FIG. 13B is a side elevation view of the machine of FIG. 13A illustrating a finish position for the incline press exercise.
Figure 14A:
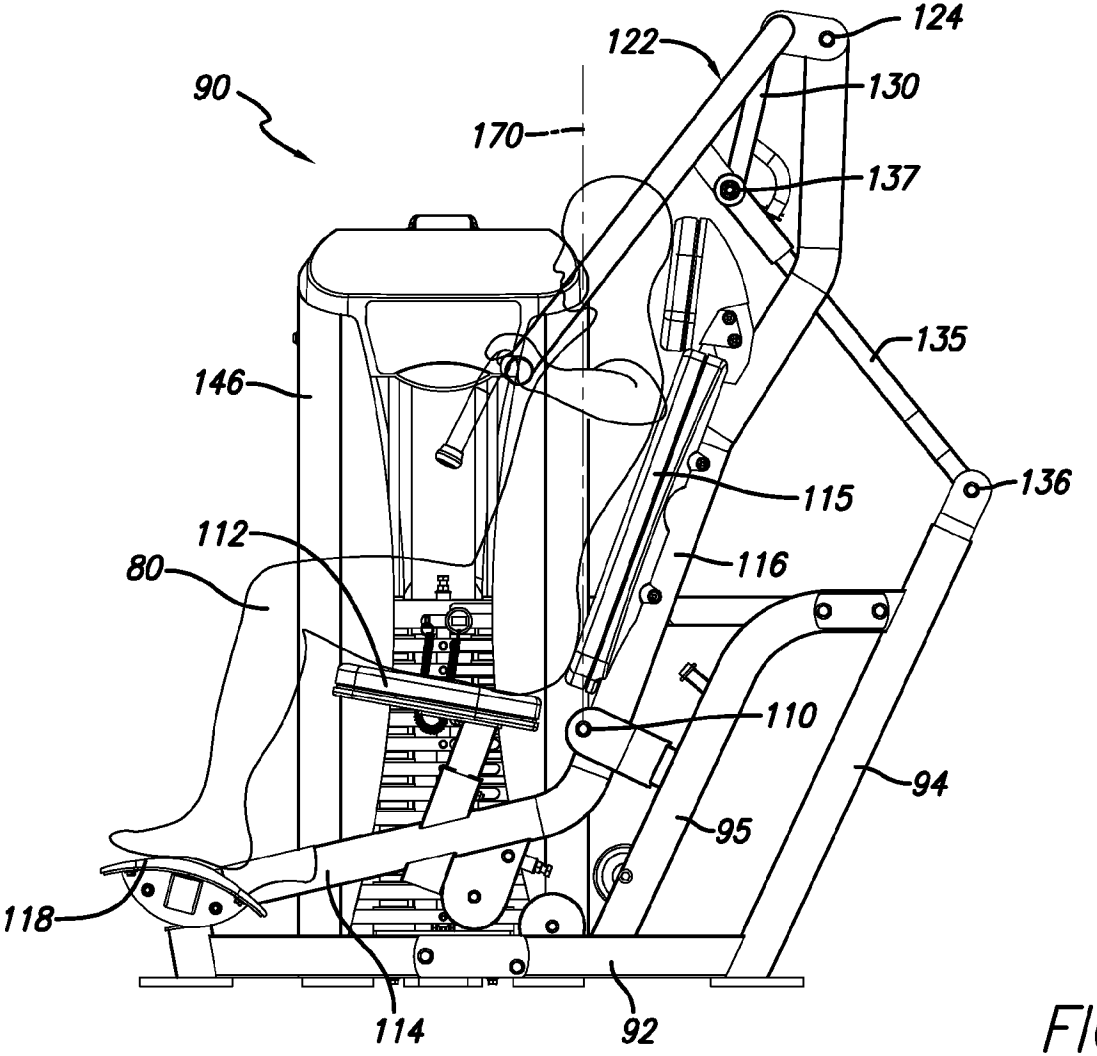
FIGS. 14A and 14B are views similar to FIGS. 13A and 13B but illustrating a seated exerciser performing an incline press exercise on the machine.

A generally "L" shaped user support frame 100 is pivotally mounted to the brace tube pivot bracket 98 for rotation about a first pivot axis 110. A primary support seat pad 112 is adjustably mounted on a forwardly extending seat portion 114 of L-shaped frame 100, and a secondary support back pad 115 is mounted on a generally upright or rearwardly inclined portion 116 of frame 100. The first pivot axis 110 is located just below the lower end of the back pad 115, as can be seen in FIGS. 10, 13 and 14. A footrest 118 is mounted at the forward end of frame 100, and rests on post 120 on the forward end of base section 92 in the exercise start position or rest position of FIGS. 9, 11, 13A, and 14A. The primary support or seat pad 112 is adjustable relative to the user support frame to vary the distance between the seat pad and user engaging handles, to allow for different size users.

A generally "U" shaped exercise arm 122 has a central web or mid-section 123 pivotally mounted to the upper end of user support frame 100 for rotation about a second pivot axis 124. Handles 125 are secured to the ends of exercise arm 122. U-shaped exercise arm 122 has a cross brace 128 transversely joining the two legs of the "U" in the upper region near the central web. A stand-off or post 130 projects downward from the web, contacting and passing the cross brace. A pivot member 132 is mounted at the end of stand-off 130.

Figure 11:
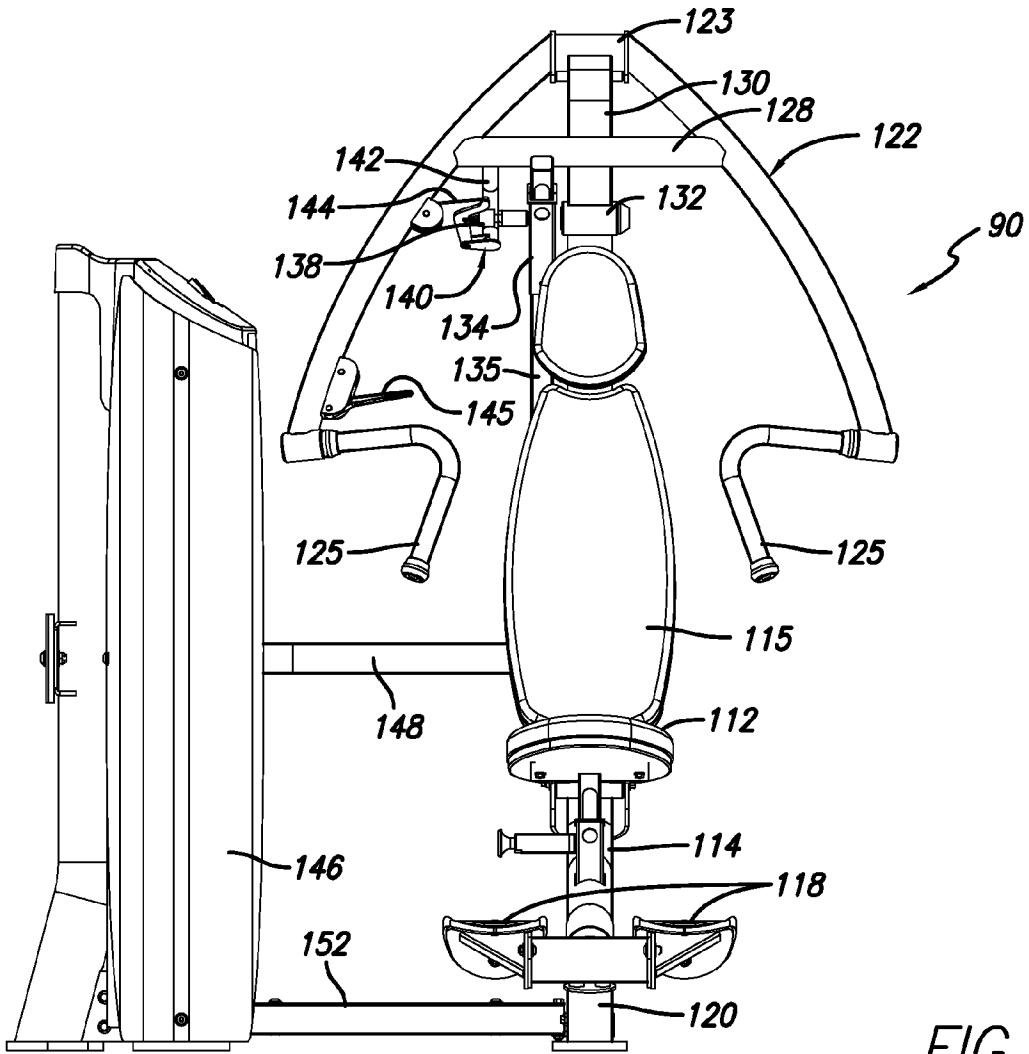
FIG. 11 is a front elevation view of the exercise machine of FIGS. 9 and 10.
Figure 12:
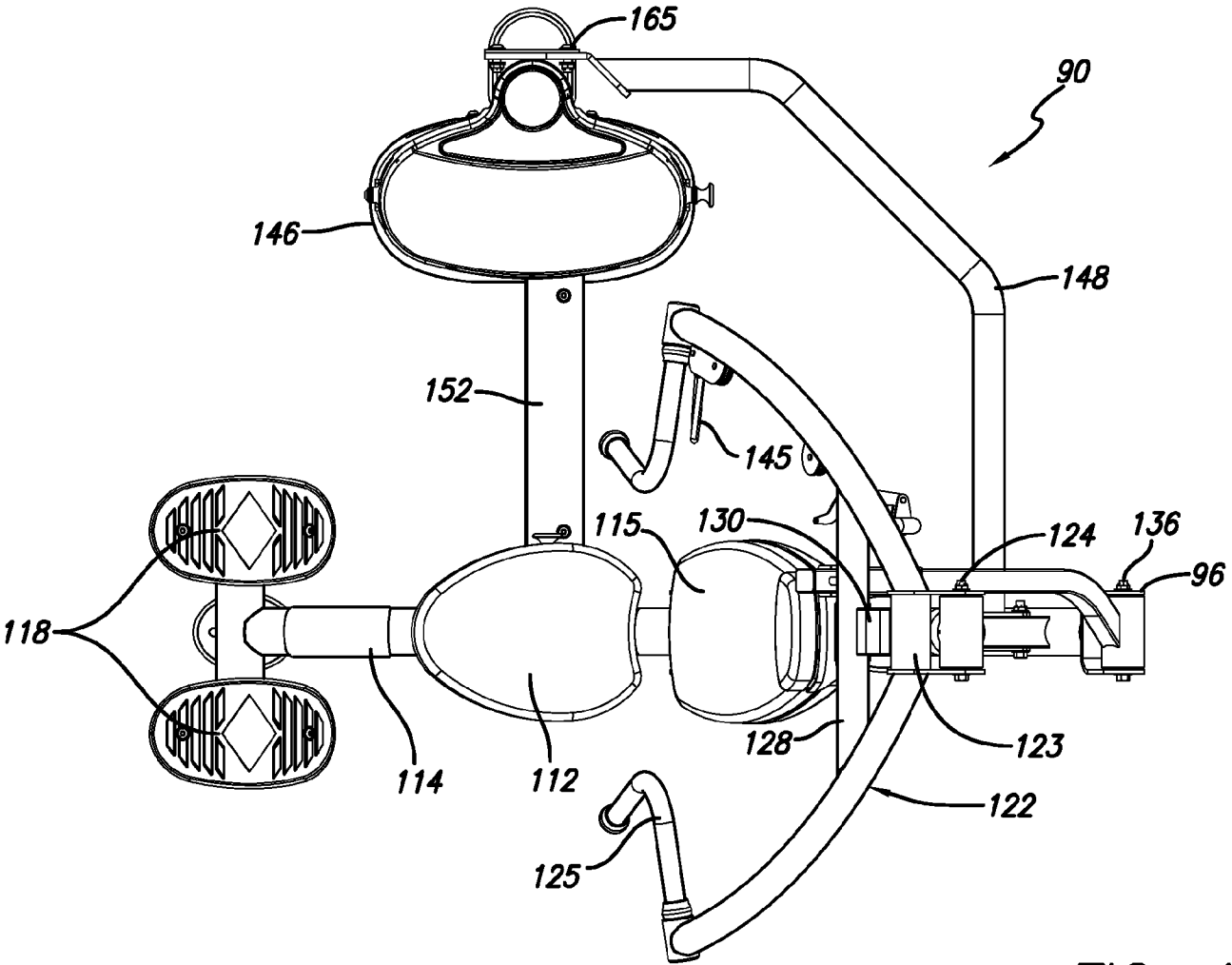
FIG. 12 is a top plan view of the exercise machine of FIGS. 9 to 11.

A connecting link 135 is pivotally connected to the upper pivot bracket 96 on the main frame for rotation about a third pivot axis 136. An exercise arm positioning device is connected between the connecting link and exercise arm. The positioning device comprises a range of motion (ROM) adjuster 134 telescopically engaged over the end of connecting link 135 and pivotally attached to the exercise arm 122 via pivot member 132 for rotation about pivot axis 137. As best illustrated in FIGS. 10 and 11, a pull pin 138 mounted to the adjuster tube 134 engages positioning holes (not visible in the drawings) located along the connecting link. A pivoting pull pin linkage 140 is mounted on the cross brace via small bent tube 142 which extends downwardly from cross brace 128 as best illustrated in FIG. 10. Pivotal linkage 140 is connected via cable 144 to an adjustment lever 145 on arm 122 adjacent one of the handles 125, as illustrated in FIG. 11.

Adjustment lever 145 and ROM 134 provide angular position adjustment of the exercise arm and allow the user to vary the starting position or "pre-stretch" for the user engaging handles and adjust the amount of exercise range of motion. Pulling on lever 145 pulls cable 144, simultaneously pulling pivotal linkage 140 connected to pull pin 138, which is pulled out of the aligned hole in connecting link 135 so that the starting position of handles 125 can be adjusted. When the lever 145 is released, the pull pin 138 snaps back into the aligned hole in connecting link 135. As the adjuster tube 134 is moved upwardly on link 135 away from pivot 136, the angle of exercise arm 122 relative to user support backrest 115 increases, moving handles 125 away from the user's body. The starting handle position is therefore varied by moving ROM adjuster 134 up and down link 135.

A vertical weight stack support frame 146 is connected to the main frame by a connecting bar 148 and houses a weight stack 150 running on two guide rods as is standard in the field. A cable and pulley system connects the elongated seat section 114 of the user support with the weight stack through guide tube 152 between the base section 92 of the main frame and the weight stack support frame 146. This arrangement provides resistance to movement by the user support. The cable and pulley system includes a cable 154 anchored beneath the elongated seat section 114 of the user support and running around a pulley 155 on the brace tube 95, a pulley 156 on the base section 92, a pulley mounted between mounting plates 158 beneath the seat section 114 of the user support, and around a generally horizontal pulley 160 at the entrance end of guide tube 152.

As in the previous embodiment, the weight stack support frame 146 can be mounted on either side of the main frame, depending on user preference and space constraints. In order to move the weight stack to the opposite side of the machine, the guide tube mounting plate 162 is removed from the first side of the base section 92 of the main frame, and the mounting plate 164 at one end of connecting bar 148 is removed from the side of the brace tube 95. The opposite end of connecting bar is also removed from the mounting plate 165 on the outer side of the weight stack support frame 146. The weight stack support frame and weight stack can now be moved to the opposite side of the machine. The guide tube 152 is secured to the second side of the base section 92 after removing plate 166 (FIG. 9). The connecting bar mounting plate 164 is secured to the second side of brace tube 95 in place of plate 168. The opposite end of the connecting bar 148 is then connected to the mounting plate 165 on the outer side of frame 146.

Figure 14B:
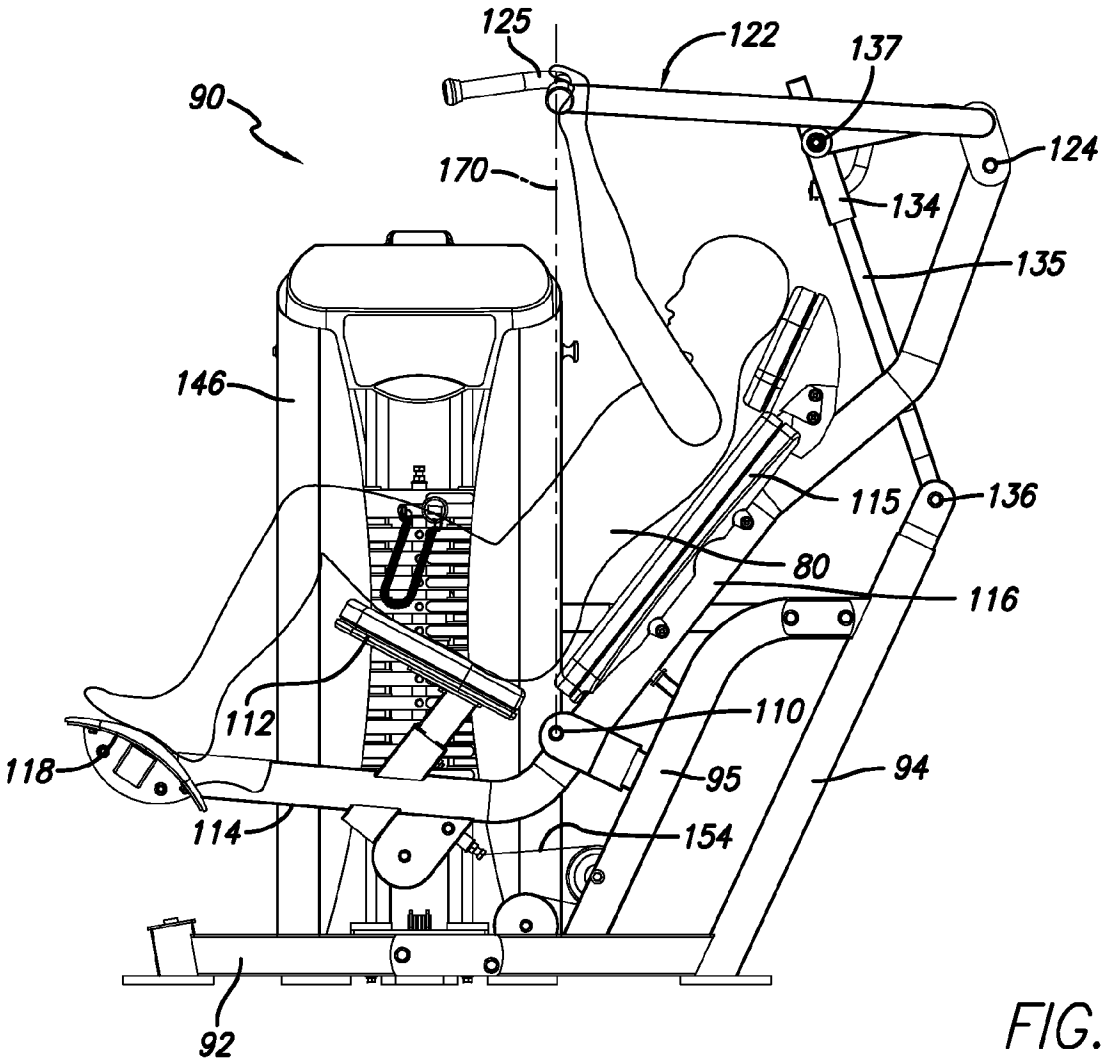

FIG. 13A illustrates the machine 90 in a start position for an incline press exercise, while FIG. 14A illustrates a user seated on the machine in the start position. To perform the exercise, the user 80 sits on the seat pad 112 after adjusting the pad to the desired height, leans against back pad 115, and places their feet on the user support footrests 118. In the start position of FIGS. 13A and 14A, the seat and the back pad rest in a slightly reclined position. The user then grabs the handles 125 of the exercise arm and pushes it forward. The angled handles 125 allow a user to grab either the horizontal or vertical part of each handle, depending on their preferred grip position. The starting position of FIG. 14A places the user in a slightly reclined position, with their hands at chest level. Pushing the exercise arm between the start position of FIG. 14A and the finish position of FIG. 14B rotates the connecting link 135 upward about pivot axis 136 where it is connected to the main frame, which in turn pulls the user support 100 causing it to rotate rearward around pivot axis 110 at its pivotal connection to the main frame. This moves the user from a slightly reclined position to a substantially reclined position, ending with their arms extending outward and their hands at forehead level, as illustrated in FIG. 14B. This movement mimics the slight, naturally arcing movement the arms go through when performing a barbell or dumbbell incline press.

The vertical gravitational centerline 170 through the user support pivot axis 110 is indicated in FIGS. 14A and 14B. Proper placement of the user support pivot results in the combined weight of the user and user support being distributed on both sides of gravitational centerline of the user support's pivotal motion, as can be seen in FIGS. 14A and 14B. This balanced weight distribution results in a portion of the user and user support being positioned on each side of the gravitational centerline in both the start and finish positions. As the exercise arm is moved, a portion of this combined weight passes through the gravitational centerline, re-distributing the weight. This re-distribution is gradual and continuous throughout the exercise motion and is not noticed by the user.

Starting the exercise with a portion of the combined weight on the directional side (side that the user support travels towards) of the gravitational centerline results in the initial lifting resistance being reduced. Finishing the exercise with a portion of the combined weight on the non-directional side prevents resistance "drop-off" at the end of the exercise. This balanced distribution of user and user support reduces the effect the combined weight has on the exercise resistance.

The exercise machines of the above embodiments place the user in a back supported starting position with their hands at chest level. Each supported exercise then follows the slight natural arcing movement of a barbell or dumbbell press and ends with the users arms extended out away from their body at the appropriate position for the exercise. Because the user support moves in conjunction with the exercise arm, the exercise arm's arcuate path relative to the user support is reduced. The result is a more natural feeling exercise movement that more closely replicates the movement found in the corresponding free weight exercise. Because the seat and back pad move together, the user remains properly positioned to the exercise arm with proper back support and does not have to try to maintain their balance.

The machines have a user engagement device or exercise arm with a linkage linking movement of the exercise arm to movement of the user support. A load provides resistance to movement of the user support, the exercise arm, and/or the connecting link. Additionally, each design has a primary user support or seat, as well as a backrest and a footrest both fixed in position relative to the seat. In an alternative embodiment, the footrest may be mounted on the frame in either of the machines described above.

The machines are configured to produce the proper starting and finishing arm/hand positions for the respective chest press exercises because the user support adjusts to the exercise arm position. The exercise arm travels separate from the user support, however the movement of the user support is dependent on and linked to the movement of the exercise arm. The handles are placed at the proper starting position for a chest press exercise, in front of the user's chest and slightly below their shoulders. Both machines described above have an exercise arm positioning device which is user activated to control the exercise start position.

Both of the above embodiments place a portion of the user's body weight (as well as the weight of the user support) on the opposite side of the gravitational centerline from the resistance, which helps to counter-balance or lessen the initial lift (starting resistance). With the combined movement to the user and user support, there is no perceived shift in the combined weight from one side of the gravitational centerline to the other and no noticeable affect on the exercise resistance felt by the user.

It should be understood that all the different elements used in the above embodiments may be mixed and interchanged with one another. The footrest in each embodiment could be stationary or move with the user support; the seat and/or back pad could be fixed or made adjustable; exercise arms could be one piece (dependent), two-piece (independent), unidirectional or bi-directional. The exercise arms may have rotational or linear movement and can be mounted on the main frame, user support or connecting link. Various types of user engaging handle or grips can be used and they can travel in a fixed movement pattern or one that is user defined. The handles may be fixed or self-aligning, rigid or flexible, and allow two dimensional or three dimensional hand movement. The connecting links could be made adjustable, solid links could be replaced with flexible ones, and the connecting links could be made to push or pull, rotate, or slide to urge rotation of the user support which can be made to rotate forward or rearward. The user support and exercise arm may travel in the same or opposite directions. Any of the various designs could have the resistance associated with any of the moving parts (user support, exercise arm or connecting link).

It should also be noted that other embodiments could use different types and forms of components without affecting the scope of this invention. Cables could be replaced with belts, ropes, chains or the like, pulleys replaced with sprockets and the seat, back pad and/or foot rest could be made adjustable. Although the exercise resistance in the above embodiments is provided by a weight stack linked to a moving part of the machine by a cable and pulley system, other types of resistance known to the art could by used such as hand-loaded weight plates, hydraulic, pneumatic, electro-magnetic or elastic bands and still work with the above embodiments. The user support of the above embodiments which supports a user in a seated position may be replaced with a user support which supports a user in a standing, kneeling or prone position in alternative embodiments.

In the above embodiments, the pivoting seat and backrest (user support) continuously and automatically self-aligns to the movement of an exercise arm throughout the entire exercise motion. This combined movement maintains a desirable alignment relationship between the exerciser, positioned on the user support, and the user engaging means (handles) on the exercise arm.

Each of the above embodiments has a floor engaging main frame; a user support pivot; a user support comprising a user support frame, a seat pad, back rest pad and foot rest; a user engaging exercise arm; a connecting link for linking movement of the exercise arm to movement in the user support frame; and a load for providing resistance to movement of the user support, exercise arm and/or connecting link. The user support is pivotally mounted to the main frame via the user support pivot. The exercise arm is movably mounted to the frame, the user support or the connecting link and has user-engaging handles approximate its outward end. The connecting link is movably associated with the user engagement means (exercise arm and handles for gripping by the user) and at least one of the other elements (main frame, user support or user support pivot), so that movement in the exercise arm translates into movement in the user support.

Proper placement of the user support pivot results in the combined weight of the user and user support being distributed on both sides of gravitational centerline of the user supports pivotal motion. This balanced weight distribution results in a portion of the user and user support being positioned on each side of the gravitational centerline in both the start and finish positions. As the exercise arm is moved, a portion of this combined weight passes through the gravitational centerline, redistributing the weight. This re-distribution is gradual and continuous throughout the exercise motion and is not noticed by the user.

Starting with a portion of the combined weight on the directional side (side that the user support travels towards) of the gravitational centerline results in the initial lifting resistance being reduced. Finishing the exercise with a portion of the combined weight on the non-directional side prevents or reduces resistance "drop-off" at the end of the exercise. This balanced distribution of user and user support reduces the effect the combined weight has on the exercise resistance.

By linking movement of the user support to movement of the exercise arm and positioning the user support pivot so that the combined weight of the user support and user is distributed on both sides of the pivot's gravitational centerline, the user support provides a counter-balancing effect on the exercise arm as it moves and its weight is re-distributed. This may avoid the need to add a heavy solid-weight for counterbalance on the outboard end of the exercise arm. The user support acts to counter-balance the exercise arm, so that rapid arm movement is less likely to cause ballistic movement to the weights.

The rocking movement of the user support in each of the above embodiments can make the exercise more fun to perform. Repetitious exercise movement can be tedious and boring. By adding motion to the user support, performing the exercise may be more enjoyable and the user's interest in their workout may increase. This is a benefit to both the individual user, who may be motivated to exercise more regularly, and the fitness facility, where retention of members is a primary objective.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. An exercise machine, comprising:

a main frame having a front end and a rear end;

a user support pivotally mounted relative to the main frame to support a user in an exercise position, the user support moving about a user support pivot axis in one direction between an exercise start position and an exercise end position during an exercise movement, the user support having a primary portion and a secondary portion which support spaced positions on a user's body throughout an exercise movement, the primary portion supporting the majority of a user's weight at least in the exercise start position of the user support, and the secondary portion being secured at a fixed angular orientation relative to the primary portion and not moving relative to the primary portion as the user support travels between the exercise start and end positions during the exercise movement;

at least one exercise arm movably mounted relative to the main frame and having at least one handle for gripping by a user positioned on the user support when performing an exercise;

a connecting link which links movement of the exercise arm to movement of the user support;

a load which resists movement of at least one of the user support, exercise arm, and connecting link; and a positioning device which is both separate and spaced from the handle and which controls positioning of the exercise arm in an exercise ready position relative to the user support, the positioning device traveling with the exercise arm and pivotally associated with at least one of the main frame and user support, and including an actuating portion adapted for direct engagement by a user prior to an exercise in order to position the exercise arm in the exercise ready position.

2. The machine of claim 1, wherein the user engageable actuating portion of the positioning device comprises a foot engageable cocking mechanism adapted for engagement by one or both feet of a user prior to performing an exercise to move the exercise arm into an exercise ready position.

3. The machine of claim 2, wherein the foot engageable cocking mechanism is associated with the connecting link.

4. The machine of claim 1, wherein the exercise arm positioning device is pivotally associated with the user support whereby adjustment of the positioning device results in movement of the user support.

5. The machine of claim 1, wherein the primary portion of the user support comprises a seat portion which supports a user in a seated position, and the secondary portion comprises a backrest portion.

6. The machine of claim 5, wherein the exercise arm is movable in one direction between an exercise ready, start position in which the handle is located at a first position in front of the backrest portion proximate a user's chest when seated on the user support, and an exercise end position spaced forwardly from the first position at the end of an exercise, whereby the combined motion of the user, user support and exercise arm substantially replicates the natural movement of the upper part of a human body when performing a free weight chest press exercise.

7. The machine of claim 6, wherein the exercise arm has a rest position in which the handle is located rearward of the exercise ready position and the arm positioning device moves the handle from the rest position to a selected exercise ready position which comprises an exercise start position.

8. An exercise machine, comprising:

a stationary main frame having a front end and a rear end;

a user support pivotally mounted relative to the main frame to support a user in an exercise position, the user support pivoting in an exercise movement in one direction between a start position and an end position;

at least one user engagement device movably mounted relative to the main frame and having at least one user engaging portion for engagement by a user positioned on the user support;

a connecting link which links movement of the exercise arm to movement of the user support;

a load which resists movement of at least one of the user support, user engagement device, and connecting link; and a floating pivot link between the user support and main frame which has a first, fixed pivot connection to the main frame defining a first pivot axis and a second pivot connection to the user support defining a second pivot axis which moves during an exercise movement in a first direction during an initial stage of the exercise movement, and reverses in direction to move in a second, reverse direction opposite to the first direction during a subsequent stage of the exercise movement, the reverse in direction of the second pivot connection occurring while the user support is traveling in one direction between the start and end position of an exercise movement.

9. The machine of claim 8, wherein the floating pivot link floats in the same position during part of the exercise movement while the user support continues to travel in said one direction, before reversing in direction to move back in the second direction.

10. The machine of claim 8, wherein the user support has a seat portion and a backrest portion, the backrest portion being secured at a fixed angular orientation relative to the seat portion and not moving relative to the seat portion and backrest portion as the user support travels between the start and end positions during the exercise movement.

11. The machine of claim 10, wherein the user support has a foot rest portion secured at a fixed position on the user support relative to the seat and backrest portions and moving together with the seat and backrest portions throughout the exercise movement.

12. The machine of claim 8, wherein the connecting link is associated with the exercise arm and is pivotally linked to the user support.

13. The machine of claim 12, further comprising a positioning device engageable by a user positioned on the user support to move the exercise arm into an exercise ready position, the positioning device being located on the connecting link.

14. The machine of claim 8, wherein the user support is pivotally linked to the main frame at a second location spaced forward from the floating pivot link.

15. The machine of claim 8, wherein the connecting link is connected to the exercise arm and travels with the exercise arm.

16. The machine of claim 8, wherein the floating pivot link is generally V-shaped and has first and second end portions, the first pivot connection located on the first end portion of the connecting link and the second pivot connection located on the second end portion of the connecting link.

17. The machine of claim 16, wherein the user support has a seat pad for supporting a user in a seated position, the first pivot connection is located on the main frame under the user support and the second pivot connection is located on the user support to the rear of the seat pad.

18. The machine of claim 8, wherein the user support has a seat pad for supporting a user in a seated position and a backrest portion for engaging a user's back when in a seated position on the user support, and the exercise arm is movable from an exercise ready, start position in which the handle is located at a first position in front of the backrest portion proximate a user's chest when seated on the user support, and an end position spaced forwardly from the first position, whereby the combined motion of the user, user support and exercise arm substantially replicates the natural movement of the upper part of a human body when performing a free weight chest press exercise.

19. An exercise machine, comprising:

a main frame having a front end, a rear end, and opposite sides;

a user support pivotally mounted relative to the main frame to support a user in an exercise position, the user support moving about a user support pivot axis in one direction between an exercise start position and an exercise end position during an exercise movement, the user support having a primary support portion and a secondary support portion which support spaced positions on a user's body, the primary support portion supporting the majority of a user's weight at least in the exercise start position of the user support, and the secondary support portion being secured at a fixed angular orientation relative to the primary support portion and not moving relative to the primary support portion as the user support travels between the exercise start and end positions during the exercise movement;

at least one user engagement device movably mounted relative to the main frame and having at least one user engaging portion for engagement by a user positioned on the user support, the user engagement device moving in one direction between a first, exercise start position and a second, exercise end position during an exercise movement;

a connecting link which links movement of the user engagement device to movement of the user support;

a load selectively positioned on either side of the main frame; and a connecting assembly which connects the load to at least one of the user support, user engagement device, and connecting link, the connecting assembly having a mount selectively attachable to the first side or the second side of the main frame.

20. The machine of claim 19, wherein the load comprises a selectorized weight stack and the connecting assembly comprises a pulley and cable system.

21. A chest press exercise machine, comprising:

a main frame having a front end and a rear end;

a user support pivotally mounted relative to the main frame to support a user in a seated position, the user support moving about a user support pivot axis in one direction between an exercise start position and an exercise end position during a chest press exercise movement, the user support having a seat portion and a backrest portion, the backrest portion being secured at a fixed angular orientation relative to the seat portion and not moving relative to the seat portion as the user support travels between the exercise start and end positions during the exercise movement;

at least one exercise arm movably mounted relative to the main frame and having at least one handle for gripping by a user seated on the user support, the exercise arm moving in a first direction during a chest press exercise movement between a start position in which the handle is located at a first position in front of the backrest portion proximate a user's chest when seated on the user support, and an end position spaced forwardly from the first position;

a connecting link linking movement of the exercise arm to movement of the user support and having a first end associated with the exercise arm, an elongate portion extending from the first end, and a first pivot connection between the connecting link and main frame located on the elongate portion and spaced from the exercise arm; and a load which resists movement of at least one of the user support, exercise arm, and connecting link;

whereby the combined motion of the user, user support, and exercise arm substantially replicates the natural movement of the upper part of a human body when performing a free weight chest press exercise.

22. The machine of claim 21, wherein the connecting link is pivotally linked to the user support at a second pivot connection spaced from the first pivot connection.

23. The machine of claim 21, wherein the connecting link has an upward extension from said first pivot connection located forward of the user support and a foot engaging cocking mechanism on the upward extension for engagement by a user seated on the user support to move the exercise arm into an exercise ready position.

* * * * *